US010855035B2

(12) United States Patent
Davidson, Jr.

(10) Patent No.: US 10,855,035 B2
(45) **Date of Patent: *Dec. 1, 2020**

(54) PUSH-ON COAXIAL CONNECTOR

(71) Applicant: PERFECTVISION MANUFACTURING, INC., Little Rock, AR (US)

(72) Inventor: Charles Darwin Davidson, Jr., Little Rock, AR (US)

(73) Assignee: PERFECTVISION MANUFACTURING, INC., Little Rock, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/512,273

(22) Filed: Jul. 15, 2019

(65) Prior Publication Data

US 2019/0348803 A1 Nov. 14, 2019

Related U.S. Application Data

(63) Continuation of application No. 16/259,456, filed on Jan. 28, 2019, now Pat. No. 10,361,521, which is a continuation of application No. 16/120,842, filed on Sep. 4, 2018, now Pat. No. 10,193,282, which is a continuation of application No. 15/898,649, filed on Feb. 18, 2018, now Pat. No. 10,069,256, which is a continuation of application No. 15/650,789, filed on Jul. 14, 2017, now Pat. No. 9,905,979, which is a continuation of application No. 15/425,314, filed on Feb. 6, 2017, now Pat. No. 9,735,520, which is a continuation-in-part of application No. 15/169,670, filed on May 31, 2016, now Pat. No. 9,577,355, which is a continuation-in-part of application No. 14/821,594, filed on Aug. 7, 2015, now Pat. No. 9,356,363.

(51) Int. Cl.

| | |
|---|---|
| ***H01R 9/05*** | (2006.01) |
| ***H01R 24/38*** | (2011.01) |
| ***H01R 43/20*** | (2006.01) |
| ***H01R 43/26*** | (2006.01) |
| *H01R 103/00* | (2006.01) |
| *H01R 13/622* | (2006.01) |

(52) U.S. Cl.

CPC ..... *H01R 24/38* (2013.01); *H01R 9/0518* (2013.01); *H01R 43/20* (2013.01); *H01R 43/26* (2013.01); *H01R 13/622* (2013.01); *H01R 2103/00* (2013.01)

(58) Field of Classification Search

CPC ..... H01R 17/12; H01R 13/65802
USPC ..... 439/578, 587, 595, 584, 607.19, 322
See application file for complete search history.

(56) References Cited

U.S. PATENT DOCUMENTS

| | | | |
|---|---|---|---|
| 2,094,187 | A | 9/1937 | Roy |
| 3,551,882 | A | 12/1970 | OKeefe |
| 3,564,487 | A | 2/1971 | Upstone |
| 7,513,788 | B2 | 4/2009 | Camelio |
| 8,075,337 | B2 | 12/2011 | Malloy |
| 8,075,338 | B1 | 12/2011 | Montena |
| 8,079,860 | B1 | 12/2011 | Zraik |
| 9,071,019 | B2 | 6/2015 | Burris |
| 9,136,654 | B2 | 9/2015 | Matzen |

(Continued)

*Primary Examiner* — Phuong Chi Thi Nguyen
(74) *Attorney, Agent, or Firm* — Paul Chancellor; Ocean Law

(57) ABSTRACT

A push-on coaxial cable connector includes a port grip, a joint, and a cable clamp.

10 Claims, 18 Drawing Sheets

(56) References Cited

U.S. PATENT DOCUMENTS

| | | | | |
|---|---|---|---|---|
| 9,356,363 | B1 * | 5/2016 | Shaw | H01R 9/0521 |
| 9,577,355 | B1 * | 2/2017 | Shaw | H01R 43/26 |
| 9,735,520 | B2 * | 8/2017 | Davidson, Jr. | H01R 43/20 |
| 9,905,979 | B2 * | 2/2018 | Davidson, Jr. | H01R 43/20 |
| 10,069,256 | B2 * | 9/2018 | Davidson, Jr. | H01R 24/38 |
| 10,193,282 | B2 * | 1/2019 | Davidson, Jr. | H01R 43/20 |
| 10,361,521 | B2 * | 7/2019 | Davidson, Jr. | H01R 9/0518 |
| 2011/0230091 | A1 | 9/2011 | Krenceski | |
| 2012/0040537 | A1 | 2/2012 | Burris | |
| 2012/0108098 | A1 | 5/2012 | Burris | |
| 2013/0178096 | A1 | 7/2013 | Matzen | |
| 2014/0137393 | A1 | 5/2014 | Chastain | |
| 2014/0154907 | A1 | 6/2014 | Ehret | |
| 2014/0322968 | A1 | 10/2014 | Burris | |

* cited by examiner

PUSH-ON COAXIAL CONNECTOR

PRIORITY CLAIM AND INCORPORATION BY REFERENCE

This application is a continuation of Ser. No. 16/259,456 filed Jan. 28, 2019, which is a continuation of Ser. No. 16/120,842 filed Sep. 4, 2018 now U.S. Pat. No. 10,193,282 which is a continuation of Ser. No. 15/898,649 filed Feb. 18, 2018 now U.S. Pat. No. 10,069,256 which is a continuation of U.S. patent application Ser. No. 15/650,789 filed Jul. 14, 2017 now U.S. Pat. No. 9,905,979 which is a continuation of U.S. patent application Ser. No. 15/425,314 filed Feb. 6, 2017, now U.S. Pat. No. 9,735,520 which is a continuation-in-part of U.S. patent application Ser. No. 15/169,670 filed May 31, 2016, now U.S. Pat. No. 9,577,355 which is a continuation-in-part of U.S. patent application Ser. No. 14/821,594 filed Aug. 7, 2015, now U.S. Pat. No. 9,356,363, all of which are incorporated herein by reference in their entireties and for all purposes.

BACKGROUND OF THE INVENTION

Coaxial cable connectors are well-known in various industries including those of the satellite and cable television ("CATV") industry. Coaxial cable connectors including F-Type connectors used in consumer applications such as consumer CATV applications are a source of service calls when service is interrupted by intermittent or lost coaxial cable connections typically involving a junction between a male connector such as an F-type connector terminating a coaxial cable and a female connector such as an F-type port located on related equipment.

Field of Invention

This invention relates to the electromechanical arts. In particular, the invention provides an electrical connector suitable for terminating a coaxial cable having a center conductor and a ground conductor surrounding the center conductor.

Discussion of the Related Art

Coaxial cable connectors include variants designed to improve one or more of connector mating, connector sealing, and electrical continuity. The care required to properly mate such connectors typically includes observing torque requirements when a threaded fastener of a first connector is engaged with a second connector. Frequently and especially with homeowner installations, one or more of inadequate training, lack of proper tools, and the need to work in confined spaces provides only a poorly mated connector. The result is typically an inoperative connection or a connection that provides only poor or decaying signal quality.

SUMMARY OF THE INVENTION

The present invention provides coaxial cable connectors such as male F-Type coaxial cable connectors. Various embodiments described herein reduce the likelihood that coaxial connectors installed without tools by the unskilled will result in troublesome mechanical and electrical connections, even in cases where connectors are mated without tools and/or in a confined space.

In an embodiment, a push-on coaxial connector comprises: a port grip connected to a cable clamp via a joint; a port grip bonnet includes a threaded mouth and an adjacent throat; a post includes a tubular stem having a stem neck adjoining an end bell; the bonnet is an electrical insulator and the post is an electrical conductor; a joint collar interposed between the bonnet and a can extending from the joint, the collar for receiving the stem neck; a first radial interference fit between the end bell and a bonnet throat wall; a second radial interference fit between the stem neck and a collar internal surface; an annular cavity between the stem and the can, the cavity for receiving a coaxial cable ground conductor and the stem for receiving a coaxial cable signal conductor; an end cap slidably engages the can and the cable is fixed within the connector when the end cap is moved toward the collar; a third radial interference fit between external port threads and the end bell formed when the connector is pushed onto a port to establish electrical continuity between a coaxial cable ground conductor and the port threads; and, a fourth radial interface fit between the bonnet threads and the port threads formed when the connector is pushed onto the port such that the bonnet grips the port and seals around a circumference of the port.

DESCRIPTION OF THE DRAWINGS

The present invention is described with reference to the accompanying figures. These figures, incorporated herein and forming part of the specification, illustrate embodiments of the present invention and, together with the description, further serve to explain the principles of the invention and to enable a person skilled in the relevant art to make and use the invention.

DETAILED DESCRIPTION OF THE PREFERRED EMBODIMENTS

The disclosure provided in the following pages describes examples of some embodiments of the invention. The designs, figures, and descriptions are non-limiting examples of selected embodiments of the invention. For example, other embodiments of the disclosed device may or may not include the features described herein. Moreover, disclosed advantages and benefits may apply to only certain embodiments of the invention and should not be used to limit the disclosed inventions.

As used herein, coupled means directly or indirectly connected by a suitable means known to persons of ordinary skill in the art. Coupled items may include interposed features such as, for example, A is coupled to C via B. Unless otherwise stated, the type of coupling, whether it be mechanical, electrical, fluid, optical, radiation, or other is indicated by the context in which the term is used.

For ease of reading, applicant may mention the number of a particular annotated item only once in each paragraph. And, where a number is mentioned, it may refer to the preceding noun phrase and not an interposed prepositional phrase. For example, "the left side of the arch 111 . . . " directs the reader to look in a related figure for the arch left side which bears the number 111. Applicant may also use a phrase like "the left side 111 of the arch 110" where the context suggests a need exists to distinguish the arch 110 from the left side of the arch 111, for example where "arch 110" is mentioned for the first time.

Figure 1:
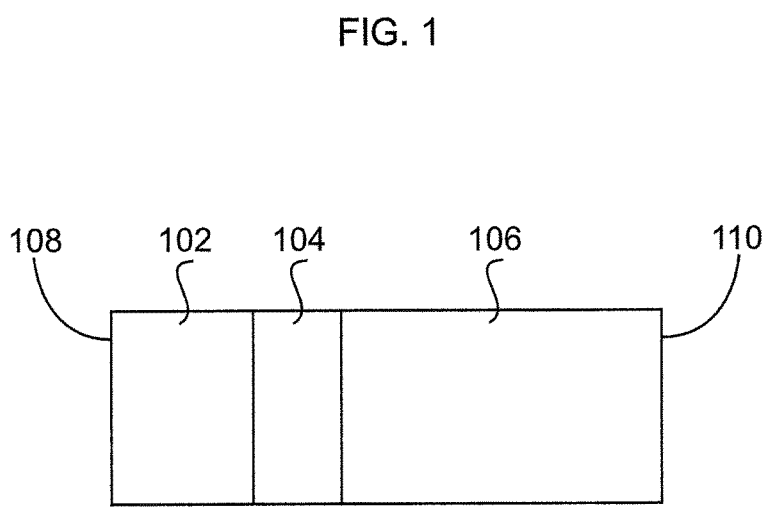
FIG. 1 shows a schematic diagram of a push-on coaxial connector.

FIG. 1 shows a schematic diagram of a first embodiment of the push-on coaxial connector of the present invention 100. A connector port grip or fastener 102 provides a mouth at its free end 108 for engaging a port such as an F female port and a connector cable clamp or cable fixation 106 provides a mouth at its free end 110 for receiving a coaxial cable such as an RG6, RG6U, RG58, RG58U, RG59, or RG59U cable. A centrally located joint or transition part 104 enables a mechanical interconnection between the port grip and the cable clamp.

Figure 2A:
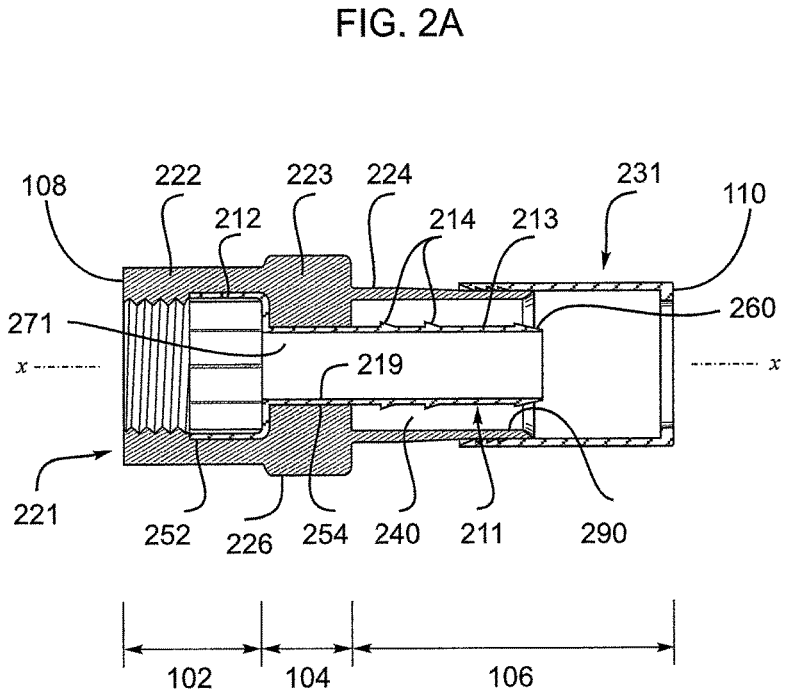
FIGS. 2A-C show cross-sectional, exploded, and perspective views of a first embodiment of the connector of FIG. 1.
Figure 2B:
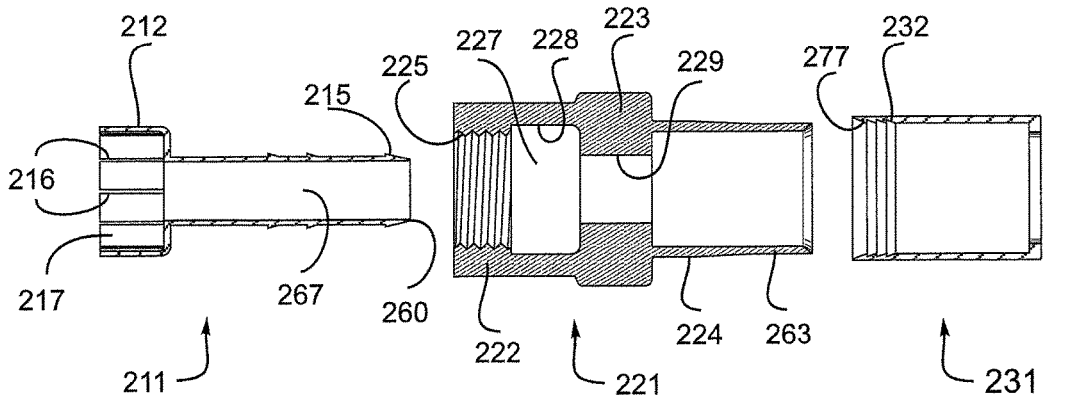
Figure 2C:
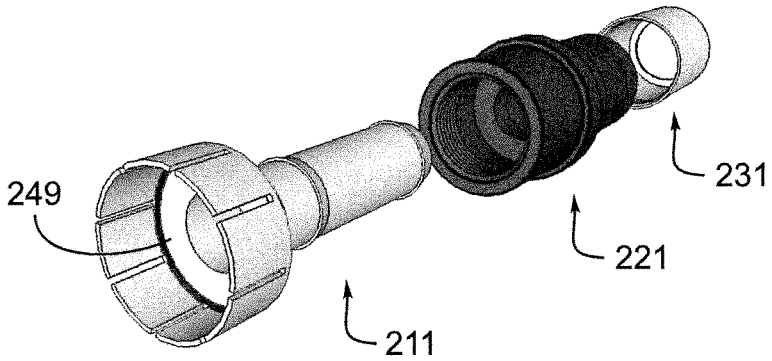

FIGS. 2A-C show cross-sectional, exploded, and perspective views of another embodiment of the push-on coaxial connector of the present invention 200A-C. The connector includes a hollow housing or shell 221, a post 211 inserted in the housing, and an end cap 231 slidably engaging the housing. These parts are arranged to form a port grip 102, a joint 104, and a cable clamp 106. Notably, the housing may be made from multiple parts or made as a single integral part as in a continuously molded or extruded part or a part machined from a piece of stock. In some embodiments, the housing is made from polymer(s) or rubber(s), for example EDPM (ethylene propylene diene monomer). And, in some embodiments, the post and/or the end cap are made from metal(s) such as a brass alloy or a nickel plated brass alloy.

The post 211 includes an end bell 212, a stem 213, and a stem neck 219 adjoining the end bell. In various embodiments, an annular disc 249 joins the end bell and the stem neck. And, in some embodiments, the post stem includes a distal end 260, distal barbs 215, and proximal barbs 214. In various embodiments, the barbs stand proud of the stem external surface. One or multiple rows of barbs may be used at each of these locations.

The port grip 102 includes a housing bonnet 222 enveloping the end bell 212 of the post 211. The bonnet 222 includes a threaded mouth 225 and an adjacent bonnet throat 227 for holding the post end bell. A mating connector such as a port (see also FIG. 3C, 340) is engaged via insertion through the threaded mouth and into the end bell.

Figure 3A:
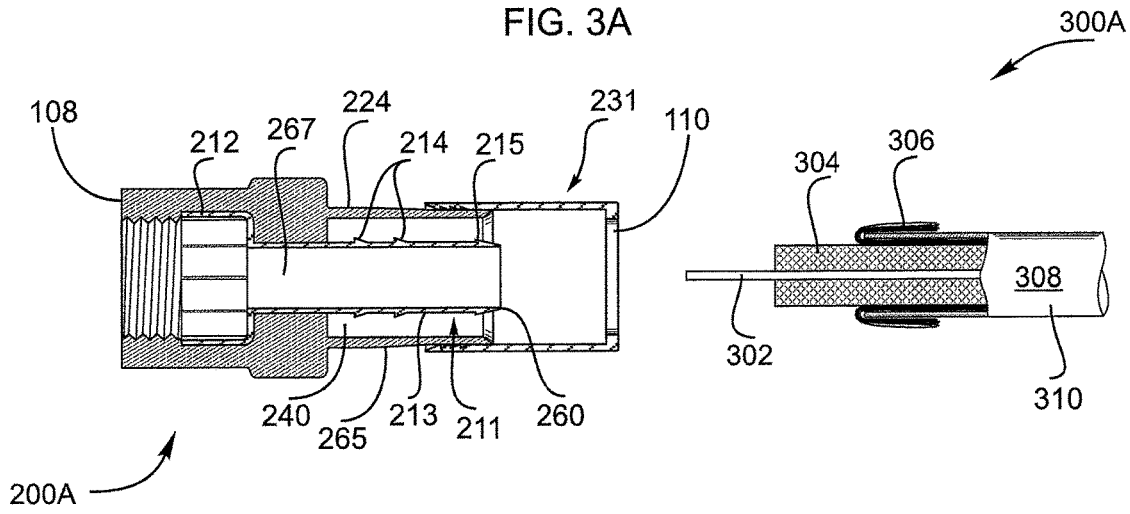
FIGS. 3A-C show cross-sectional, exploded, and perspective cable installation views of an embodiment of the connector of FIG. 1.
Figure 3B:
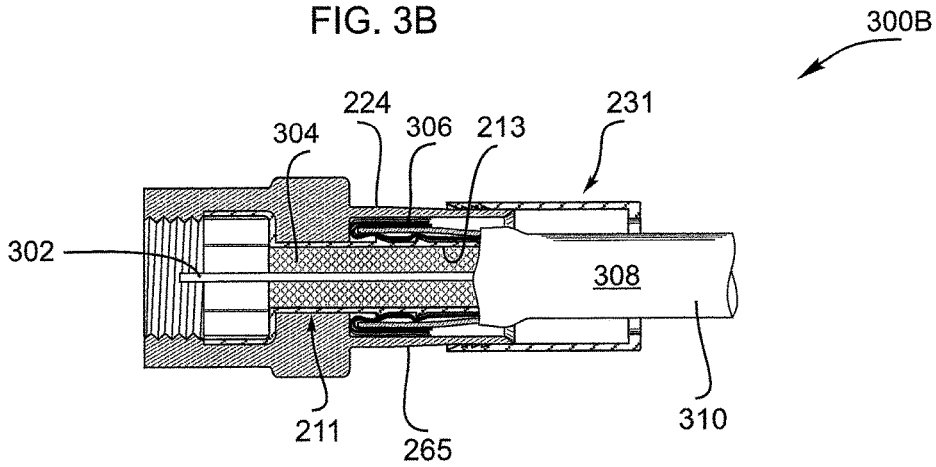
Figure 3C:
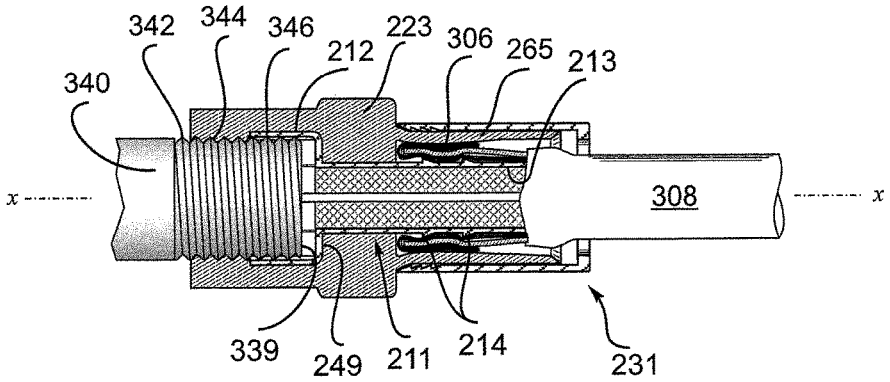

Mechanical engagement of the connector 200A with a mated port includes, for example, bonnet 222 to port engagement and end bell 212 to port engagement (see also FIG. 3C, 340). Electrical contact of the connector with a mated port includes, for example, end bell to port engagement. And, in some embodiments, sealing contact of the connector with a mated port includes bonnet to port engagement (see also FIG. 3C, 344) as between the bonnet threads 225 and the port or external threads of the port (see also FIG. 3C, 340, 342). Notably, use of the term "bonnet threads" refers to an irregular surface within the bonnet suitable for engaging and/or sealing the bonnet with a mating connector such as the port. In some embodiments, the bonnet threads are ⅜-32 UNEF type threads that are molded into the bonnet.

In various embodiments, a radial interference fit 252 between a wall 228 of the throat 227 and the end bell 212 resists rotation of the bonnet 222 and/or the housing 221 about the post 211. And, in various embodiments, radial forces exerted by the bonnet 222 around a circumference of the end bell enhance port to end bell contact as by pressing the end bell against the port. The end bell may be slotted 216 to form end bell fingers 217 that more readily and resiliently grasp an inserted port.

The joint 104 includes a housing collar 223 through which the post 211 is inserted. In particular, the post stem neck 219 is positioned in the housing collar.

In various embodiments, a radial interference fit 254 between a wall 229 of the collar 223 and the stem neck 219 resists rotation of the collar and/or the housing 221 about the post 211. And, in combination, the collar and the stem neck provide a passageway 271 for a coaxial cable 308 center conductor 302, the passageway lying between the port grip 102 and the cable clamp 106 (see also FIG. 3A). Embodiments may provide feature(s) at a joint periphery 226 useful for gripping and pushing the connector onto a mating part such as a port. Such features may include one or more of suitable raised surfaces, depressions, knurls, or similar geometry(ies).

The cable clamp 106 includes a housing can 224, a trailing portion of the post stem 213, and an end cap 231. The can encircles the post stem 213 and/or the post stem barbs 214, 215 and the end cap slidably engages the can.

In some embodiments, the end cap 231 encircles the can 224 and at least one of the can and the end cap has a peripheral wall of varying thickness. For example, the can may have a variable wall thickness 263 wherein a can wall thickness near the collar 223 is greater than a can wall thickness near a can entry mouth 290. In some embodiments, a portion of the can wall is tapered such that the can wall thickness is diminished moving toward the can entry mouth. As skilled artisans will appreciate, embodiments wherein a taper varies the outside diameter of the can provide for a clamping action when an end cap sliding toward the collar compresses the can. In some embodiments, the can compression is greatest near the proximal barb(s) 214 or near the collar 223.

Figure 2D:
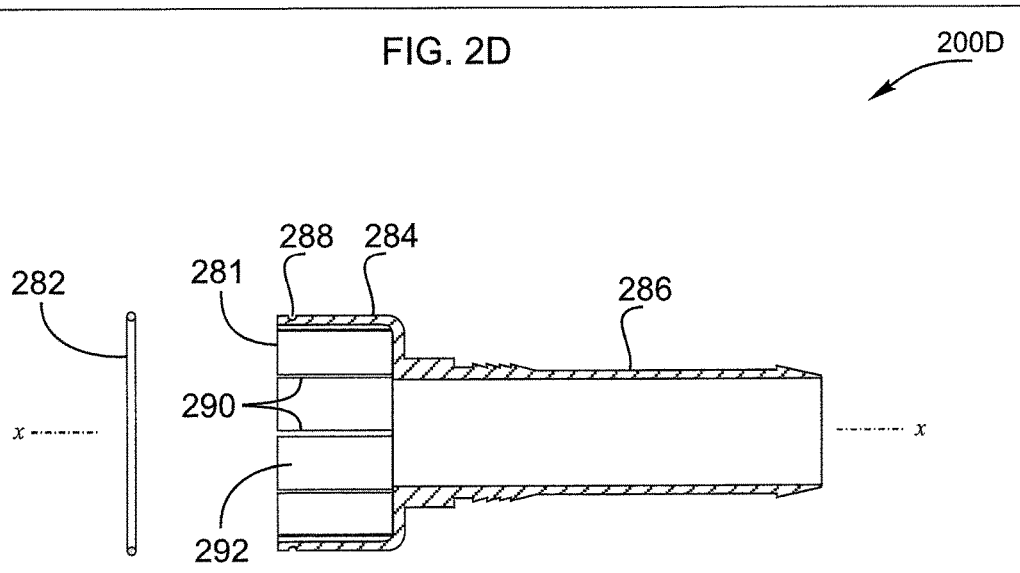
FIGS. 2D-E show cross-sectional and perspective views of an alternative post for use in the connector of FIG. 2A.
Figure 2E:
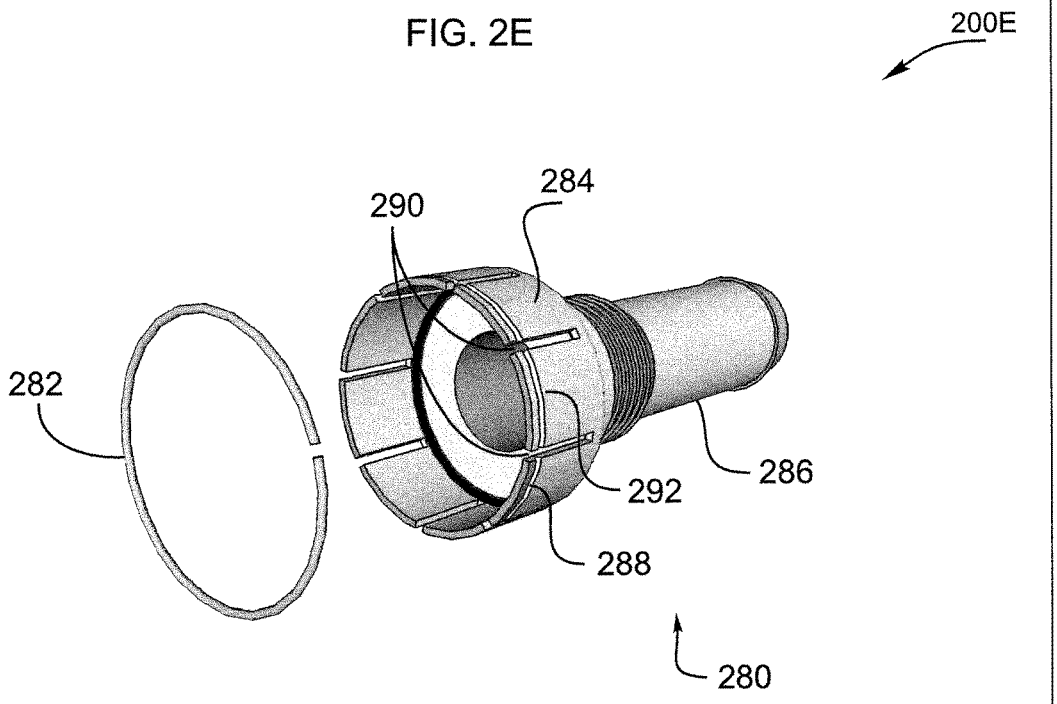

FIGS. 2D-E show exploded and perspective views of an alternate post embodiment 200D-E. Here, the post 280 includes an end bell 284 and a stem 286. Longitudinal end bell slots 290 define end bell fingers 292. The end bell includes a circumferential external groove 288 near its mouth 281 for receiving a spring ring 282. When the spring ring is installed in the groove, it tends to resiliently bend the fingers inward toward a longitudinal axis x-x. With some springs and in some embodiments, a corresponding and opposite groove in the bonnet throat wall 228 provides at least a portion of the space required by the spring. As skilled artisans will appreciate, embodiments of the spring ring may enhance the force with which the fingers grasp an inserted port. The spring ring may be made of one or more of high-carbon steel, oil-tempered low-carbon steel, chrome silicon steel, chrome vanadium steel, stainless steel, beryllium copper alloy, phosphor bronze, and titanium.

In various embodiments, the post may include a plurality of parts that are joined by one or more of crimping, staking, soldering, brazing, spot welding, welding with or without added welding material, interlocking, interference fit, and the like. For example, the post may comprise two parts to be joined such as an end bell 284 and stem 286. In some embodiments the end bell includes two parts to be joined such as a hoop 208 and an annular disk or backwall 209. In some embodiments, the backwall and the stem are formed from a tube and are for joining with a hoop.

Figure 2F:
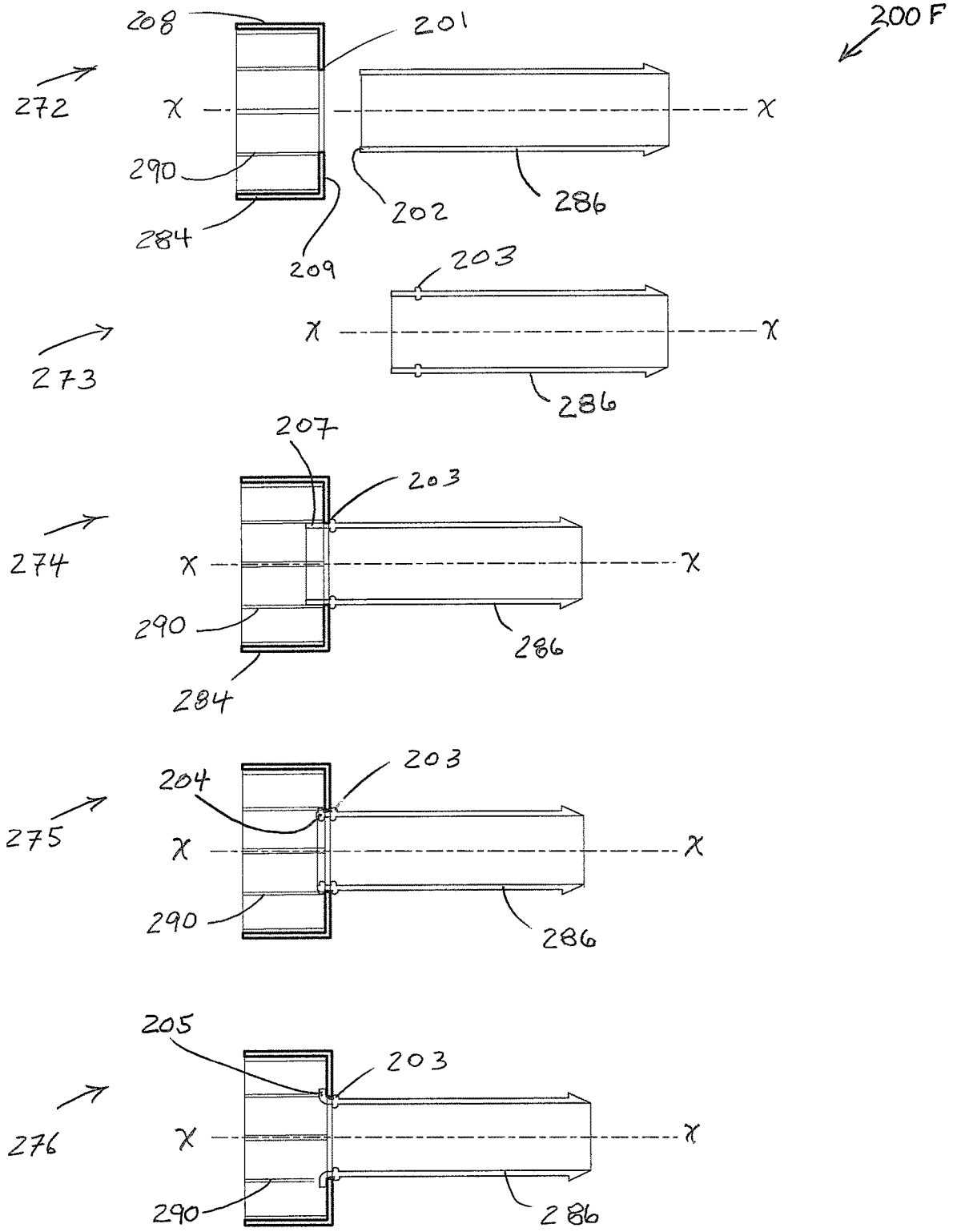
FIG. 2F shows cross-sectional views of a multipart post for use with embodiments of the connector of FIG. 1.

FIG. 2F shows cross-sectional views of some of the joined part post embodiments mentioned above 200F. Here, a multipart post assembly such as a two part assembly includes an end bell 284 and a stem 286. In the figure, steps 272-276 show exemplary fabrication processes.

In a first step 272, an end bell 284 with a back wall 209 and a hollow stem 286 are provided. In a second step 273, the stem is processed to provide an electrically conductive raised surface feature 203 for stopping the end bell. In a third step 274 the stem is inserted in a central hole 201 of the end bell 284 back wall 209 such that the end bell contacts the first raised feature 203. In a fourth step 275, a small portion of the stem 207 that protrudes into the hoop 208 is processed to provide a second electrically conductive surface feature 204 for fixing the end bell against the first raised surface feature 203. Further processing may include enhancements including any of the joining methods mentioned above, for example a spot or heat weld joining the back wall 209 and one of the raised surface features.

In steps 273 and 275, the raised surface feature(s) may be provided by deformation such as compression (as shown), as by material addition (e.g. weld material), as by part addition (e.g. adding a bumper ring), and the like. Shown in step 273 is a raised surface feature resulting from e.g., a longitudinal compressing operation and/or a radial expansion operation. Shown in step 275 is a raised surface feature resulting from e.g., a flared tube end 205.

In various embodiments, measures are taken to enable a port inserted in the end bell 284 to contact the back wall 209. For example, the raised surface feature 205 and/or the backwall 209 may be processed to reduce the projection of the raised surface feature into the hoop 208. For example, the back wall may be shaped to receive the raised surface feature 205 in an annular socket formed by a back wall thickness reduction. For example, the thickness of the back wall may be selected to provide a suitably long interference fit with the stem end 202 thereby avoiding a stem projection into the hoop.

FIGS. 3A-C show installation 300A-C of a coaxial cable with a coaxial connector similar to the connector of FIG. 2A. As shown in FIG. 3A, a prepared end of a coaxial cable 308 is for installation in a coaxial connector 200A.

The coaxial cable 308 includes a center or signal conductor 302 and an outer or ground conductor 306. A dielectric layer 304 encircles the center conductor and a jacket 310 encircles the outer conductor. The center conductor is typically a single wire while the outer conductor(s) typically includes a braid layer which is turned back over the jacket during preparation of the cable end. As skilled artisans will appreciate, the coaxial cable may incorporate additional conductors such as foil and/or additional braid layers that surround the center conductor as found in multi-shielded coaxial cables.

As shown in FIG. 3A, prior to insertion of the coaxial cable 308 into the connector 200A, the connector end cap 231 is located behind a can wall external taper 265 and presents a free end mouth 110 for entry of the coaxial cable.

As shown in FIG. 3B, when the cable is inserted into the connector, the cable braid 306 and jacket 310 enter the annular space 240 between the post stem 213 and the can 224 while the cable center conductor 302 and dielectric 304 enter the post central passage 267. As seen, insertion of the cable into the connector requires that the post stem distal end 260 enter the cable between the outer braid layer 306 and the dielectric layer 304. When the cable is completely inserted in the connector, a length of bare center conductor protrudes into the bonnet 222.

As shown in FIG. 3C, the inserted cable can be fixed or clamped within the connector by movement of the end cap 231. In particular, as the end cap slides along the can 224 toward the collar 223, the can wall external taper 265 is forced inward toward the longitudinal axis x-x such that the can presses the braid 306 against the post stem 213. In some embodiments the can presses the braid against proximal post barbs 214 for enhancing the mechanical and/or electrical connection between the cable and the connector. Movement of the end cap toward the collar may be stopped by end cap abutment with the collar.

As skilled artisans will appreciate, the cable clamping method described above is but one of several cable fixing methods that might be used in various embodiments of the present invention. For example, a plug type end cap that slidably fits within the can might be used with suitable fixing features and/or structures including one or more of taper(s) on the plug, taper(s) on the can 224, and a wedge part (See e.g., FIG. 7A, 761) moved by the plug for forcing the braid 306 against the post 211.

And, as shown in FIG. 3C, when the connector 200A is pushed onto a mating part such as a port 340, the end bell 212 of the post 211 receives the port or the port threads 342 at a radial end bell to port interference fit 346. As skilled artisans will appreciate, this arrangement provides an electrical path such as a ground path extending from the port or port threads to the coaxial cable outer conductor 306 via the post. For clarity, FIGS. 3C-D show the port partially inserted into the end bell such that a port end face 339 does not contact the post annular disk 249.

Figure 3D:
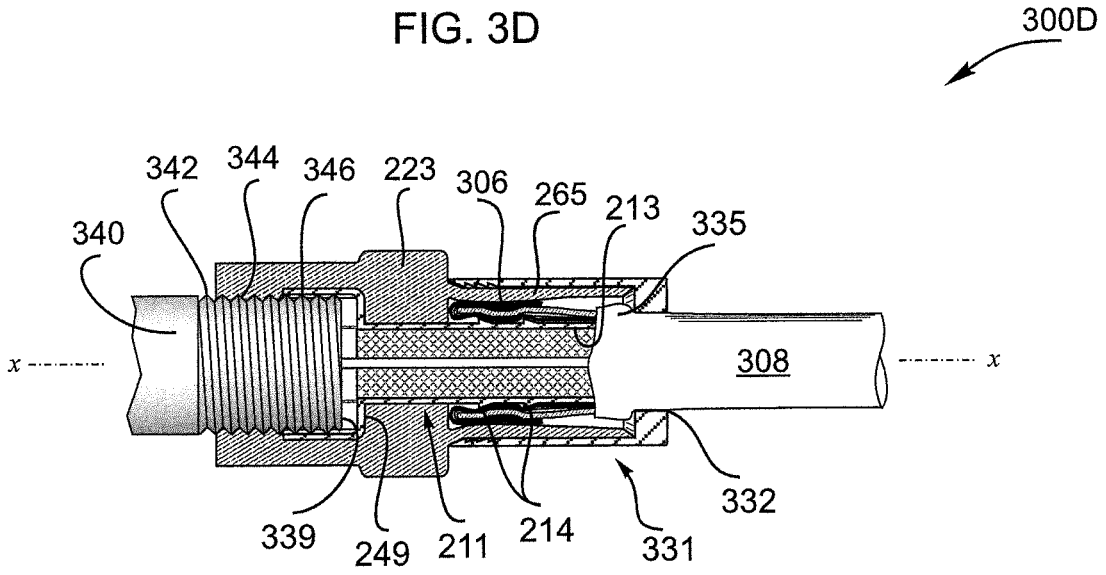
FIG. 3D is another embodiment of the connector of FIG. 3C.

FIG. 3D shows a coaxial cable installed in a connector 300D similar to that of FIG. 3C. In particular, the connector utilizes an end cap 331 with a mouth 332 that closely receives a coaxial cable 308. For example, for a coaxial cable such as an RG-6 dual, tri or quad shield cable, a gap between the mouth and the cable may vary in a range of about 0.12 to 0.5 mm when the cable and end cap are coaxially arranged.

Within the end cap 331, an enlarged cable diameter 335 at the distal post barb 215 is larger than the end cap mouth such that the enlarged cable diameter abuts the end cap. Because the end cap has internal teeth such as angled teeth or ridges 277 at its leading end 232, the end cap resists movement away from the collar 223 and provides a means for fixing the cable within the connector.

As mentioned above when a connector (e.g., 200A) is pushed onto a mating part such as a port 340, the end bell 284 of the post 211 receives the port or the port threads 342 at a radial end bell to port interface such as an interference fit 346. And as mentioned in connection with FIG. 2E, a ring such as an end bell compression ring 282 may be used to enhance interference fits between the post end bell 284 and a connector 340 inserted therein. Various housing 221 designs may also be used to enhance the force the end bell exerts on a connector inserted therein via housing material(s) selection, housing thicknesses, and housing to end bell radial interference fits.

FIGS. 3E-O show various end bell compressing housing designs 300E-O. In some embodiments, the housing may be made from any of resilient material(s) and/or elastomers such as thermoplastic elastomers.

Figure 3E:
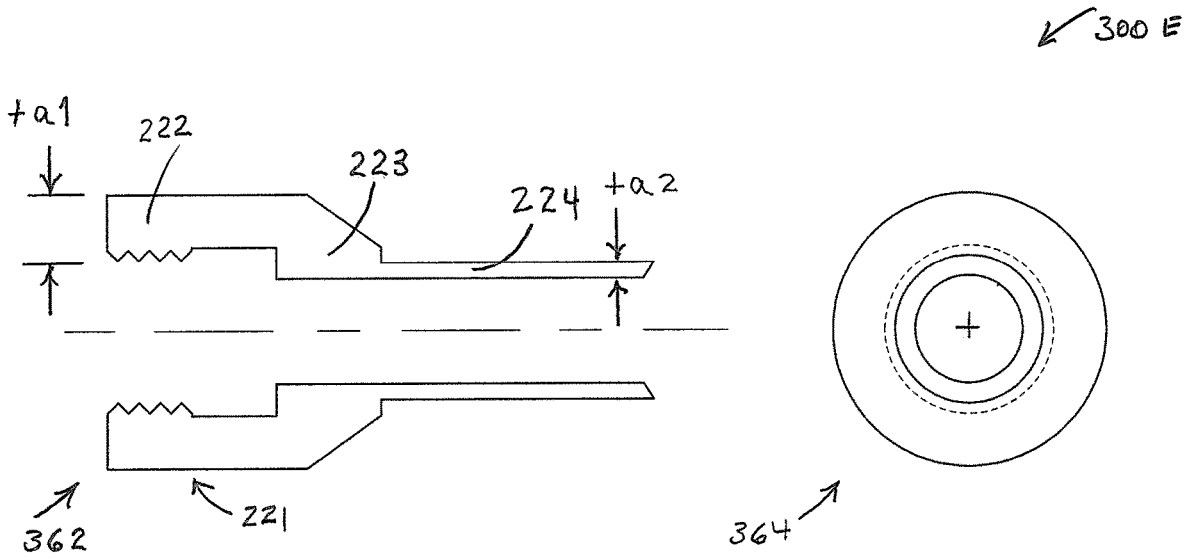
FIGS. 3E-O show housings for use with embodiments of the connector of FIG. 1.

FIG. 3E shows a resilient and/or elastomeric housing 300E. In particular, cross-sectional 362 and bonnet end 364 views are shown. The housing includes collar section 223 interconnecting front bonnet 222 and rear can 224 sections. As seen, the collar provides a housing thickness transition from ta2 to ta1 where ta2<ta1. The ratio of (ta1/ta2) may have any one of the approximate thickness ratios 3:1, 4:1, 5:1, 6:1, 7:1, 8:1, 9:1, 10:1. For a given housing material and can thickness ta2, increasing thickness ratios provide increased resistance to bonnet radial expansion and therefore greater forces available to constrain end bell 284 radial expansion. In particular, increasing thickness ratios may increase the forces holding the end bell against an inserted port 340 and may increase forces holding the bonnet against the inserted port.

FIGS. 3F-3M show a first group of housings with variable wall thickness 300F-M.

Figure 3F:
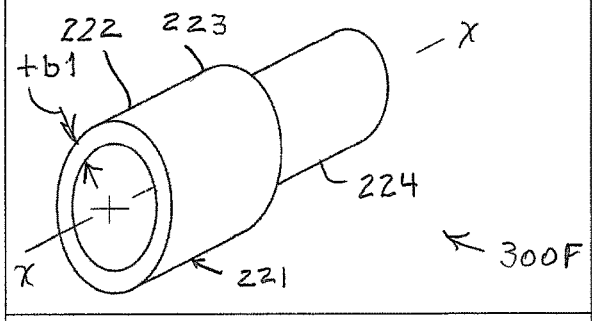
Figure 3G:
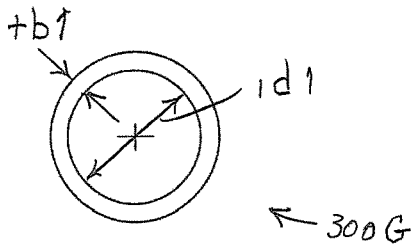

FIGS. 3F-G show a resilient and/or elastomeric housing 300F-G. In particular, cross-sectional FIG. 3F and bonnet end FIG. 3G views are shown. The housing includes a collar section 223 interconnecting front bonnet 222 and rear can 224 sections. Bonnet thickness tb1 may be varied as described above to increase the forces holding the end bell against an inserted port 340 and to increase forces holding the bonnet against an inserted port. Notably, yet another means to increase a radial compressive force applied to the end bell 284 is to reduce the bonnet internal diameter id1.

Figure 3H:
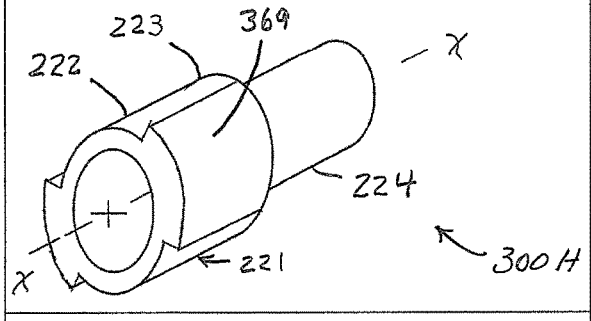
Figure 3I:
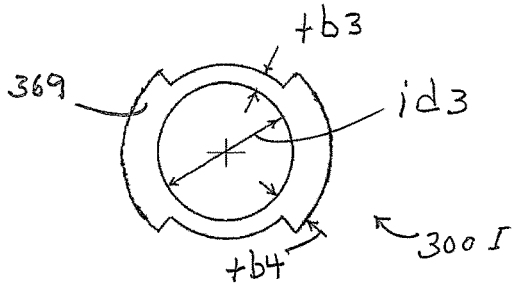

FIGS. 3H-I show a resilient and/or elastomeric housing 300H-I. In particular, cross-sectional FIG. 3H and bonnet end FIG. 3I views are shown. The housing includes a collar section 223 interconnecting front bonnet 222 and rear can 224 sections. Here, the bonnet includes first tb3 and second tb4 bonnet wall thicknesses where (tb3<tb4) and ratios (tb4/tb3) may be any of approximately 1.2:1, 1.4: 1, 1.6:1, 1.8:1, 2:1, 2,2: 1, 2.4:1. As shown, substantially rectangular projections extend from bonnet opposing sides. These projections provide thick bonnet portions with a thickness tb4 which results in thin bonnet sections tb3 between the projections. Where the projections extend the length of the bonnet, they tend to increase compressive forces holding the end bell against an inserted port 340 and increases forces holding the bonnet against an inserted port. In the alternative, the projections may be positioned to enhance compressive forces on the end bell or forward of the end bell. Notably, yet another means to increase a radial compressive force applied to the end bell 284 and port is to reduce the bonnet internal diameter id3.

Figure 3J:
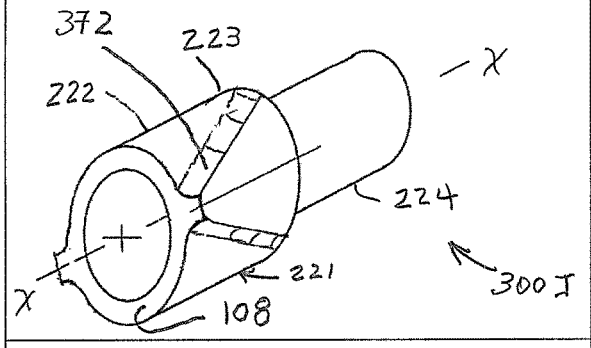
Figure 3K:
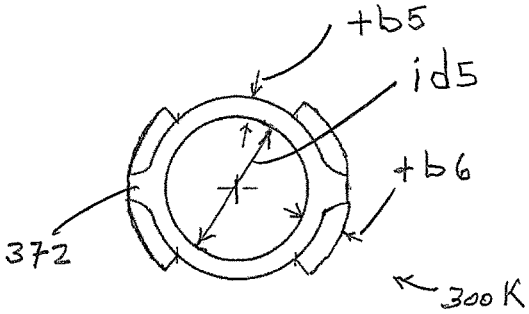

FIGS. 3J-K show a resilient and/or elastomeric housing 300J-K. In particular, cross-sectional FIG. 3J and bonnet end FIG. 3K views are shown. The housing includes a collar section 223 interconnecting front bonnet 222 and rear can 224 sections. Here, the bonnet includes first tb5 and second tb6 bonnet wall thicknesses where (tb5<tb6) and ratios (tb6/tb5) may be any of approximately 1.2:1, 1.4: 1, 1.6:1, 1.8:1, 2:1, 2,2: 1, 2.4:1. As shown, substantially triangular projections pointed toward the bonnet mouth 108 extend from bonnet opposing sides. These projections provide thick bonnet portions with a thickness tb6 which results in thin bonnet sections tb5 between the projections. Such projections enable the bonnet to provide increasing compressive forces moving from the bonnet mouth 108 toward the can 224. Notably, yet another means to increase a radial compressive force applied to the end bell 284 and port is to reduce the bonnet internal diameter id5.

Figure 3L:
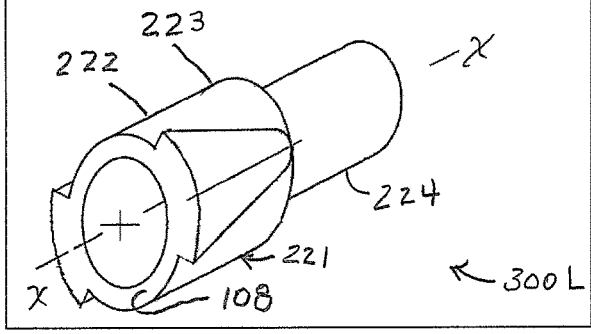
Figure 3M:
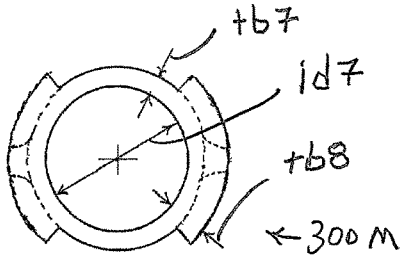

FIGS. 3L-M show a resilient and/or elastomeric housing 300L-M. In particular, cross-sectional FIG. 3L and bonnet end FIG. 3M views are shown. The housing includes a collar section 223 interconnecting front bonnet 222 and rear can 224 sections. Here, the bonnet includes first tb7 and second tb8 bonnet wall thicknesses where (tb7<tb8) and ratios (tb8/tb7) may be any of approximately 1.2:1, 1.4: 1, 1.6:1, 1.8:1, 2:1, 2,2: 1, 2.4:1. As shown, substantially triangular projections pointed toward the can 224 extend from bonnet opposing sides. These projections provide provides thick bonnet portions with a thickness tb8 which results in thin bonnet sections tb7 between the projections. Such projections enable the bonnet to provide decreasing compressive forces moving from the bonnet mouth 108 toward the can 224. Notably, yet another means to increase a radial compressive force applied to the end bell 284 and port is to reduce the bonnet internal diameter id7.

Figure 3N:
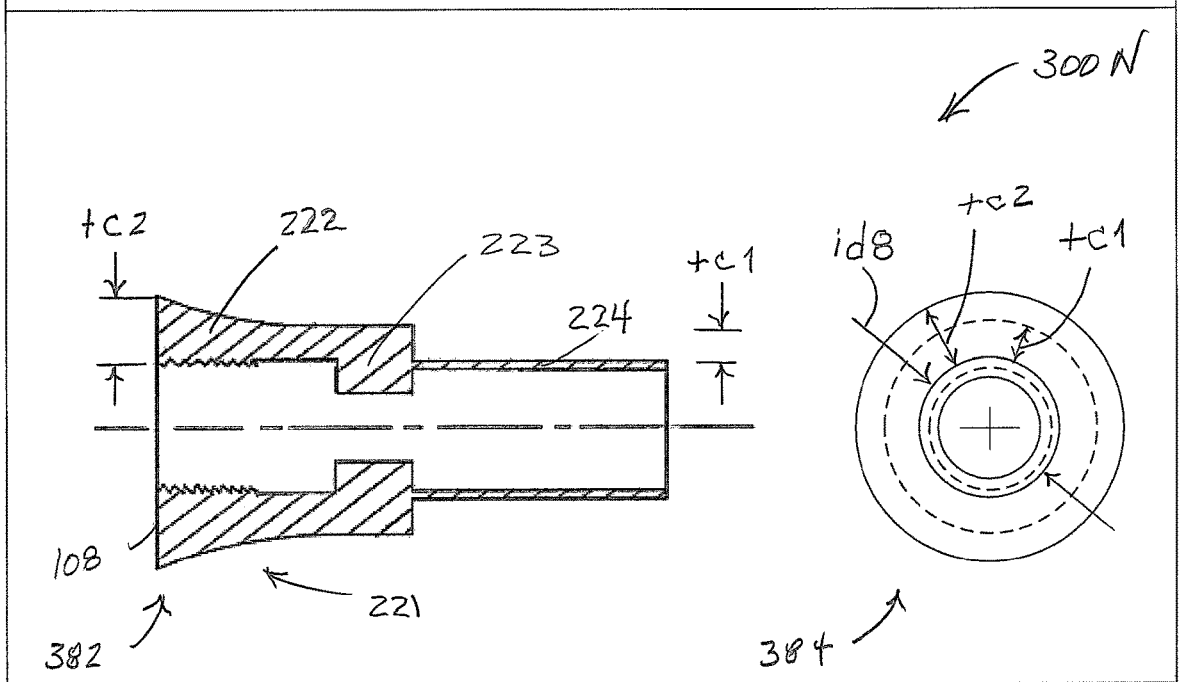
Figure 3O:
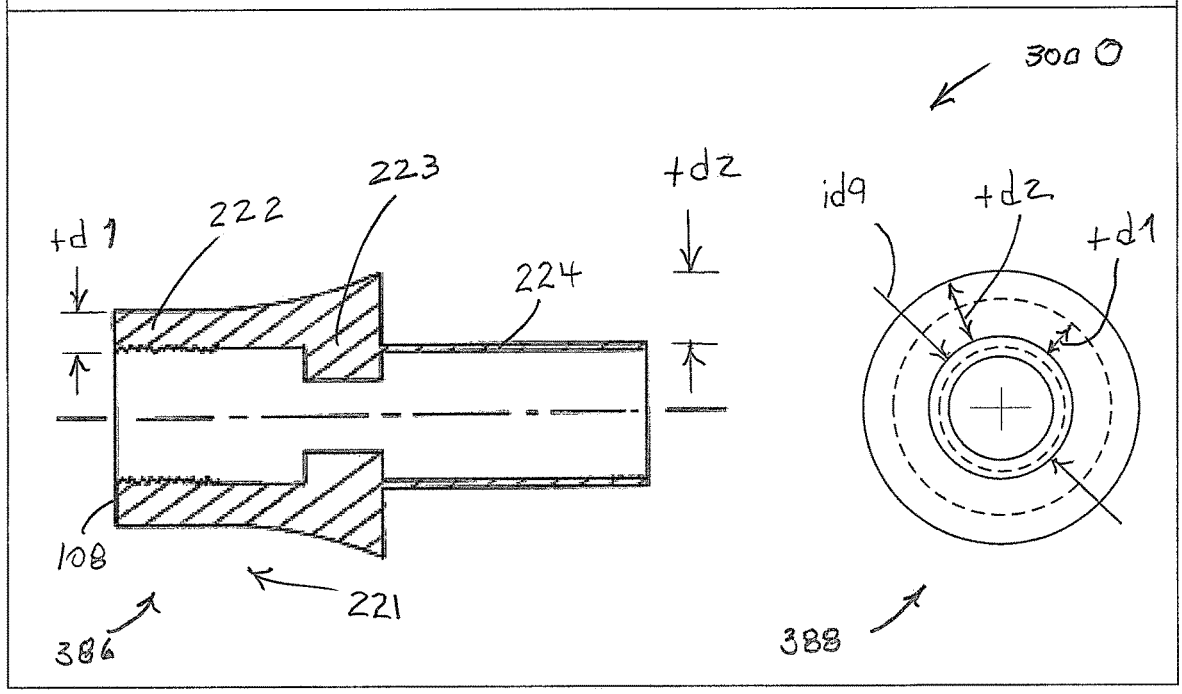

FIGS. 3N-O show a second group housings with variable wall thickness 300N-O.

FIG. 3N shows a resilient and/or elastomeric housing 300N. In particular, cross-section 382 and bonnet end 384 views are shown. The housing includes a collar section 223 interconnecting front bonnet 222 and rear can 224 sections. Here, the bonnet outer surface is curved such that a bonnet wall thickness varies continuously from tc2 at the bonnet mouth to tc1 at a point near the collar where (tc1<tc2) and ratios (tc2/tc1) may be any of approximately 1.2:1, 1.4: 1, 1.6:1, 1.8:1, 2:1, 2,2: 1, 2.4:1. This variable bonnet wall thickness provides for a decreasing bonnet applied radial compressive force moving from the bonnet mouth 108 toward the can. Notably, yet another means to increase a radial compressive force applied to the end bell 284 and port is to reduce the bonnet internal diameter id8.

FIG. 3O shows a resilient and/or elastomeric housing 300 O. In particular, cross-section 386 and bonnet end 388 views are shown. The housing includes a collar section 223 interconnecting front bonnet 222 and rear can 224 sections. Here, the bonnet outer surface is curved such that a bonnet wall thickness varies continuously from td1 near the bonnet mouth to tc2 at a point near the collar where (td1<td2) and ratios (td2/td1) may be any of approximately 1.2:1, 1.4: 1, 1.6:1, 1.8:1, 2:1, 2,2: 1, 2.4:1. This variable bonnet wall thickness provides for an increasing bonnet applied radial compressive force moving from the bonnet mouth 108 toward the can. Notably, yet another means to increase a radial compressive force applied to the end bell 284 and port is to reduce the bonnet internal diameter id9.

Yet other means for applying radial compression forces to the end bell 284 include various external spring or resilient members. For example, a slotted cylinder encircling the housing bonnet 222 may be made from a resilient material such as spring steel such that the cylinder diameter must increase in order for the end bell to radially expand when a port 340 is received therein.

Figure 4A:
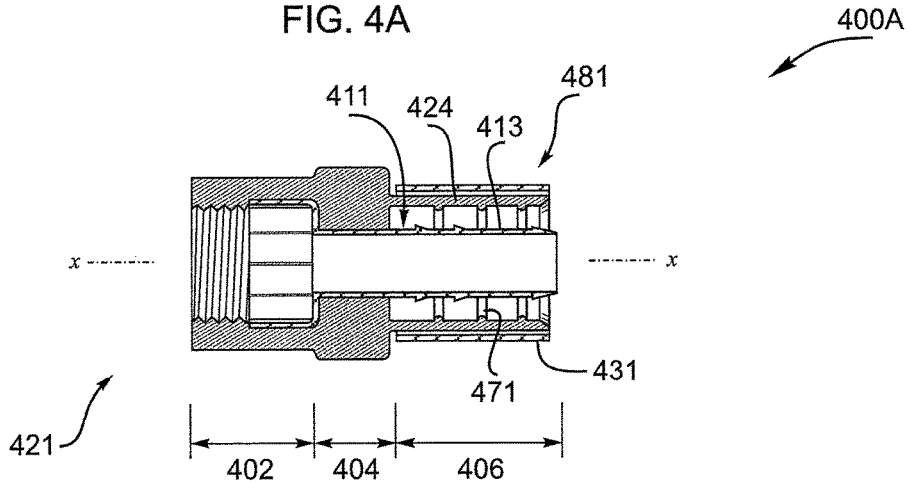
FIGS. 4A-E show cross-sectional, exploded, and perspective views of a second embodiment of the connector of FIG. 1.
Figure 4B:
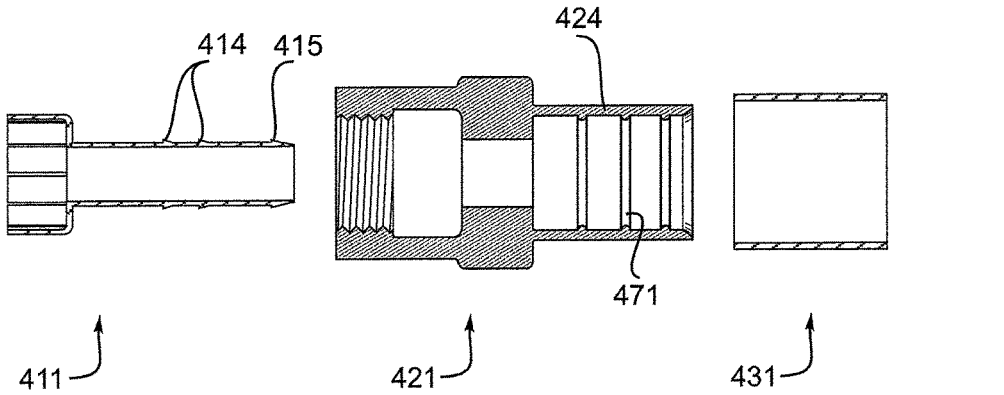
Figure 4C:
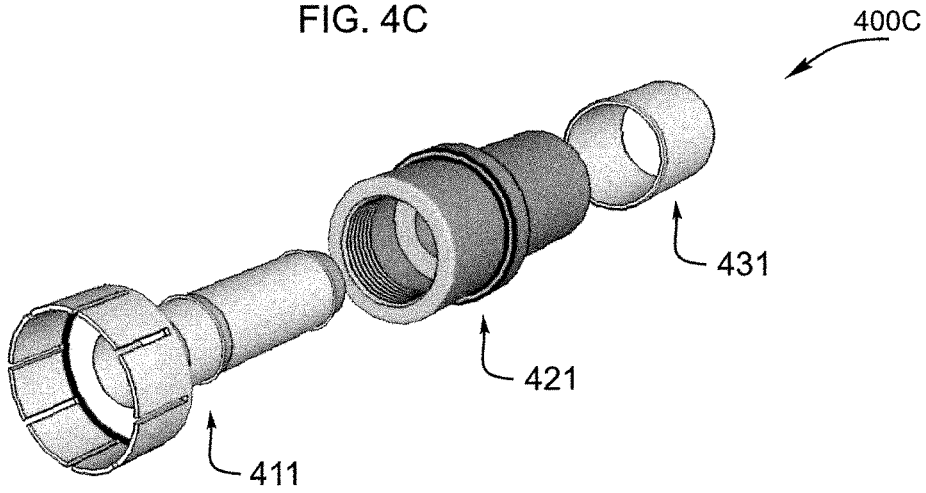

FIGS. 4A-C show cross-sectional, exploded, and perspective views of another embodiment of the push-on coaxial connector of the present invention 400A-C. The connector includes a hollow housing 421, a post 411 inserted in the housing, and a crimp ring or end cap 431 slidably engaging the housing. The connector parts may be made from any suitable material(s) including polymers, metals, and composites. For example, the housing may be made from a polymer such as a rubber while the post and end cap may be made from a brass alloy or a nickel plated brass alloy.

These parts are arranged to form a port grip 402, a joint 404, and a cable clamp 406. The port grip 402 and joint 404 are similar to those found above in FIGS. 2A-C.

The cable clamp 406 includes a housing can 424, a trailing portion of the post stem 413, and an end cap 431. The can encircles the post stem 413 and/or post stem barbs 414, 415 and the end cap slidably engages the can. In various embodiments, the cable is fixed in the connector by one or more of the structures and methods described above in connection with FIGS. 2A-C, 3A-B.

Among other things, the cable clamp 406 may be configured to better seal against moisture ingress and to better accommodate a variety of external coaxial cable diameters. The can 424 may include an internal surface raised with respect to the longitudinal axis x-x, for example, as shown in FIG. 4A, one or more spaced apart circumferential ridges 471.

As skilled artisans will appreciate, deformation of the housing can 424 may be used to fix a coaxial cable 308 within the connector and this housing can deformation may occur when the end cap 431 encircling the housing can is deformed.

Figure 4D:
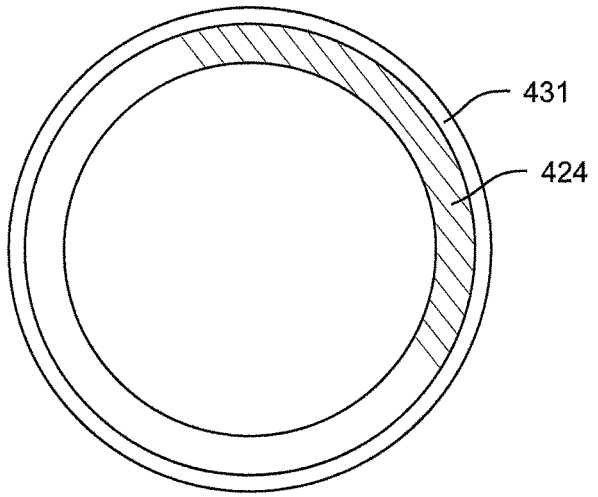

FIG. 4D shows a pre-deformation cross-section 400D through the cable clamp 406 of the connector 400A of FIG. 4A. As shown, before deformation a substantially circular end cap 431 encircles a substantially circular housing can 424.

Figure 4E:
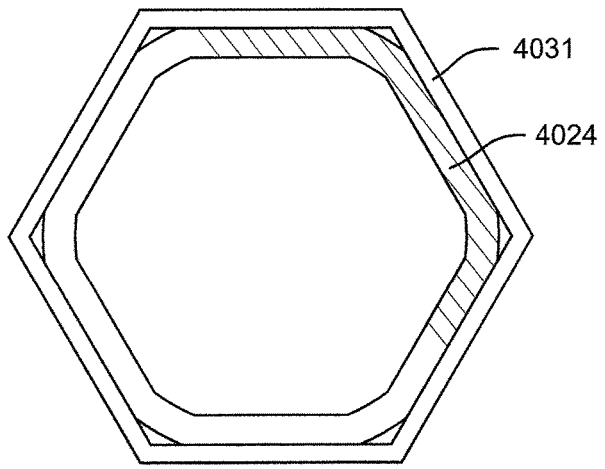

FIG. 4E shows a post-deformation cross-section 400E through the cable clamp 406 of the connector 400A of FIG. 4A. For clarity, this figure omits a coaxial cable 308 normally inserted prior to deformation. As shown, after deformation a substantially polygonal end cap 4031 encircles a substantially polygonal housing can 4024. Deformation similar to that illustrated here may be accomplished by using a compression or crimping tool that is known in the CATV industry or a tool that is specially designed to accommodate the connector of FIG. 4A. In various embodiments, the deformed end cap 4031 may have a hexagonal cross-section as seen in FIG. 4E. Other exemplary embodiments may have three, four, five, or seven sided cross-sections.

Figure 5A:
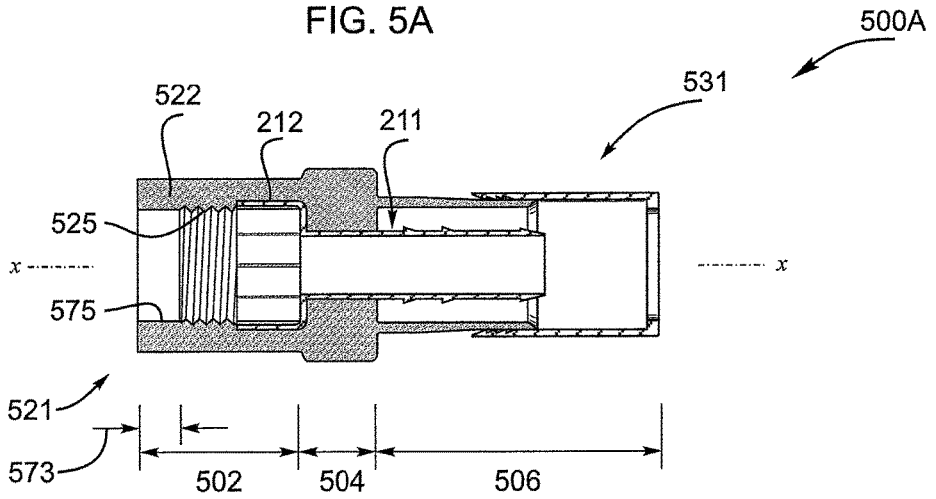
FIGS. 5A-C show cross-sectional, exploded, and perspective views of a third embodiment of the connector of FIG. 1.
Figure 5B:
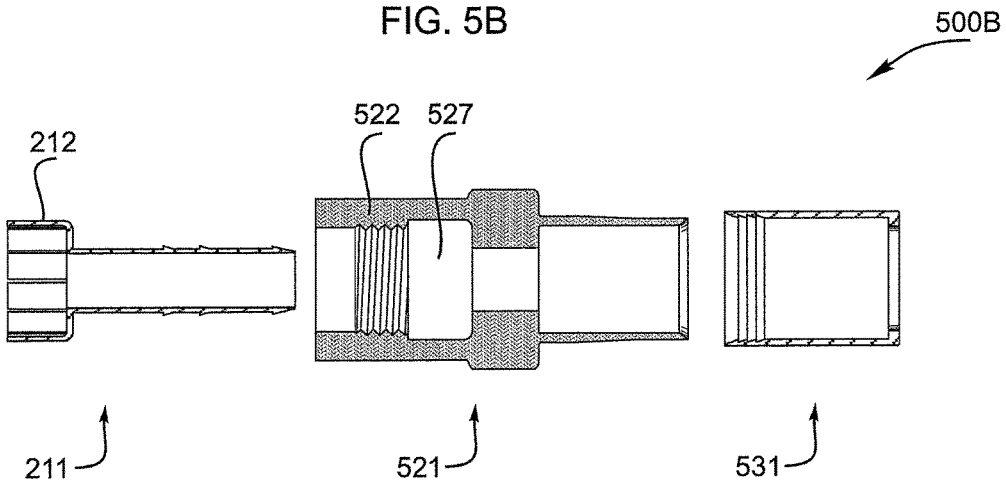
Figure 5C:
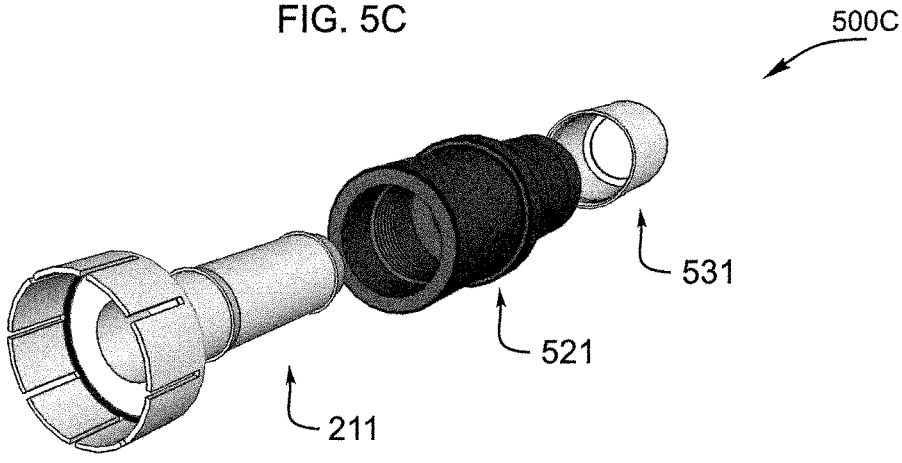

FIGS. 5A-C show cross-sectional, exploded, and perspective views of another embodiment of the push-on coaxial connector of the present invention 500A-C. The connector includes a hollow housing 521, a post 211 inserted in the housing, and an end cap 531 slidably engaging the housing. The connector parts may be made from any suitable material(s) including polymers, metals, and composites. For example, the housing may be made from a polymer such as a rubber while the post and end cap may be made from a brass alloy or a nickel plated brass alloy.

These parts are arranged to form a port grip 502, a joint 504, and a cable clamp 506. The joint 504 and the cable clamp 506 are similar to those of FIGS. 2A-C.

The port grip 502 includes a housing bonnet 522 enveloping an end bell 212 of the post 211. The bonnet 522 includes a threaded zone 525 between a bonnet mouth 573 and a bonnet throat 527. In various embodiments, the threaded zone and bonnet throat are similar to those mentioned above.

Among other things, the bonnet mouth 573 may provide improved mechanical coupling between the connector 500A and a port and improved resistance to ingress of moisture between the bonnet 522 and the port. In some embodiments, the bonnet mouth has a smooth inner wall 575 for sealing against a mated port.

Figure 6A:
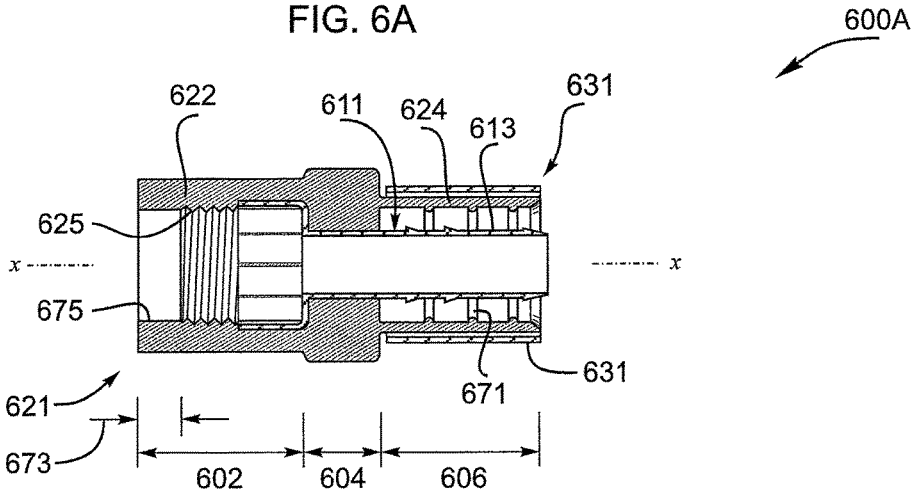
FIGS. 6A-C show cross-sectional, exploded, and perspective views of a fourth embodiment of the connector of FIG. 1.
Figure 6B:
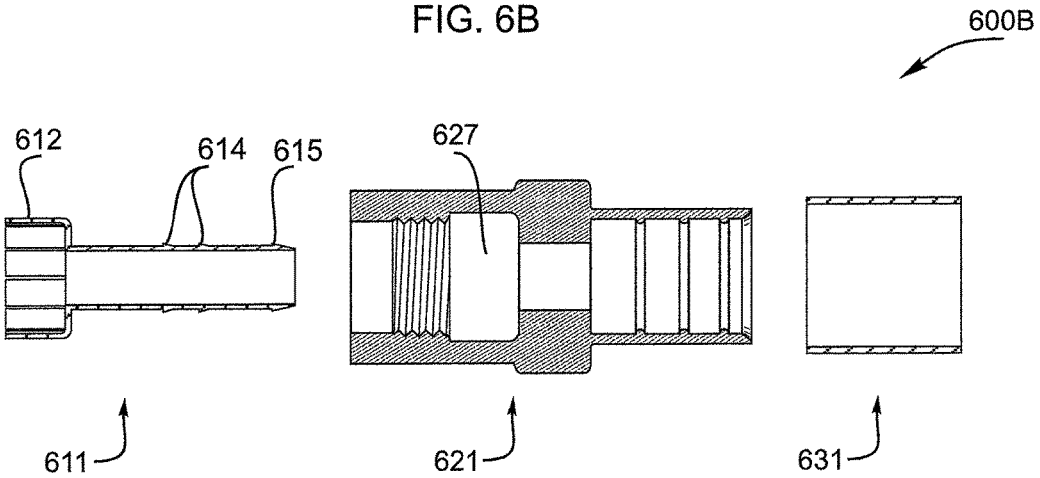
Figure 6C:
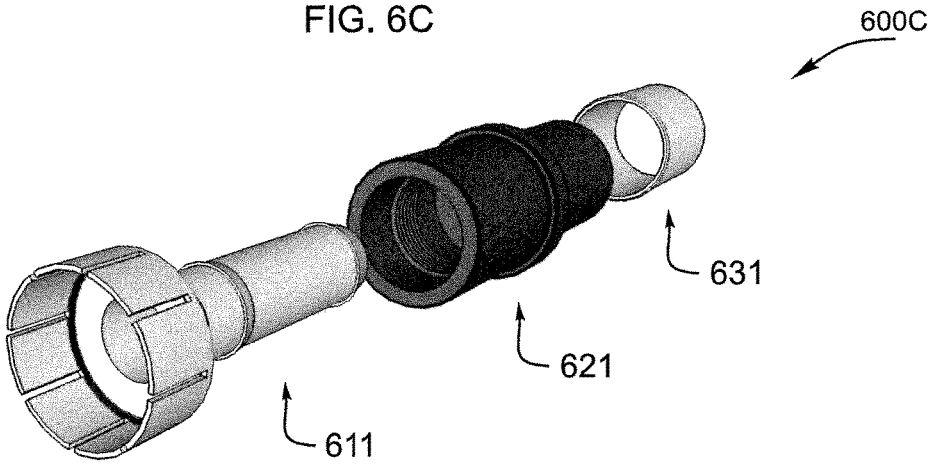

FIGS. 6A-C show cross-sectional, exploded, and perspective views of another embodiment of the push-on coaxial connector of the present invention 600A-C. The connector includes a hollow housing 621, a post 611 inserted in the housing, and a crimp ring or end cap 631 slidably engaging the housing. These parts are arranged to form a port grip 602, a joint 604, and a cable clamp 606.

The cable clamp 606 includes a housing can 624, a trailing portion of the post stem 613, and an end cap 631. The can encircles the post stem 613 and/or post stem barbs 614, 615 and the end cap slidably engages the can. In various embodiments, the cable is fixed in the connector by one or more of the structures and methods described above in connection with FIGS. 2A-C, 3A-B.

Among other things, the cable clamp 606 may be configured to better seal against moisture ingress and to better accommodate a variety of external coaxial cable diameters. The can 624 may include an internal surface raised with respect to the longitudinal axis x-x, for example, as shown in FIG. 6A, one or more spaced apart circumferential ridges 671. And, the end cap may have a polygonal cross-section, for example, as shown in FIG. 6C, a hexagonal cross-section normal to the longitudinal axis x-x. Other exemplary embodiments may have three, four, five, or seven sided cross-sections.

As skilled artisans will appreciate, deformation of the housing can 624 may be used to fix a coaxial cable 308 within the connector and this housing can deformation may occur when the end cap 631 encircling the housing can is deformed. See FIGS. 4D-E and the related description above for exemplary means and methods of deformation.

The port grip 602 includes a housing bonnet 622 enveloping an end bell 612 of the post 611. The bonnet 622 includes a threaded zone 625 between a bonnet mouth 673 and a bonnet throat 627. In various embodiments, the threaded zone and bonnet throat are similar to those mentioned above.

Among other things, the bonnet mouth may provide improved mechanical coupling between the connector 600A and a port, and improved resistance to ingress of moisture between the bonnet 622 and a mating part such as a port. In some embodiments, the bonnet mouth has a smooth inner wall 675 for sealing against a mated part.

The connector parts may be made from any suitable material(s) including polymers, metals, and composites. For example, the housing may be made from a polymer such as a rubber while the post and end cap may be made from a brass alloy or a nickel plated brass alloy.

Figure 7A:
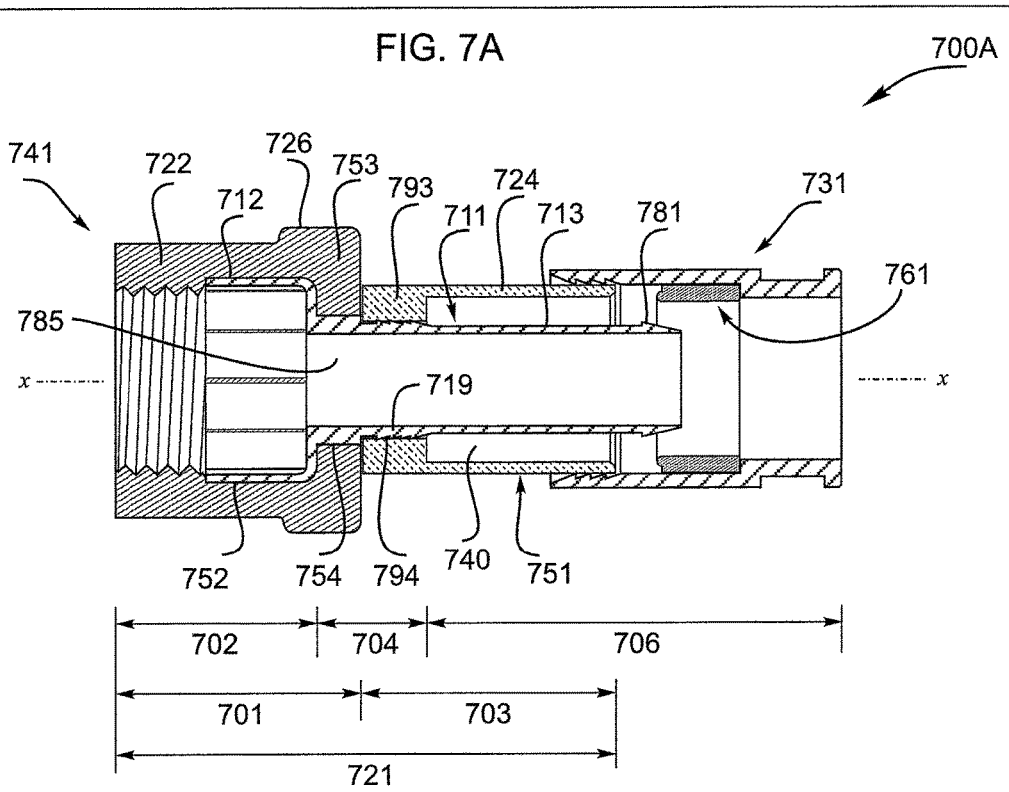
FIGS. 7A-C show cross-sectional, exploded, and perspective views of a fifth embodiment of the connector of FIG. 1.
Figure 7B:
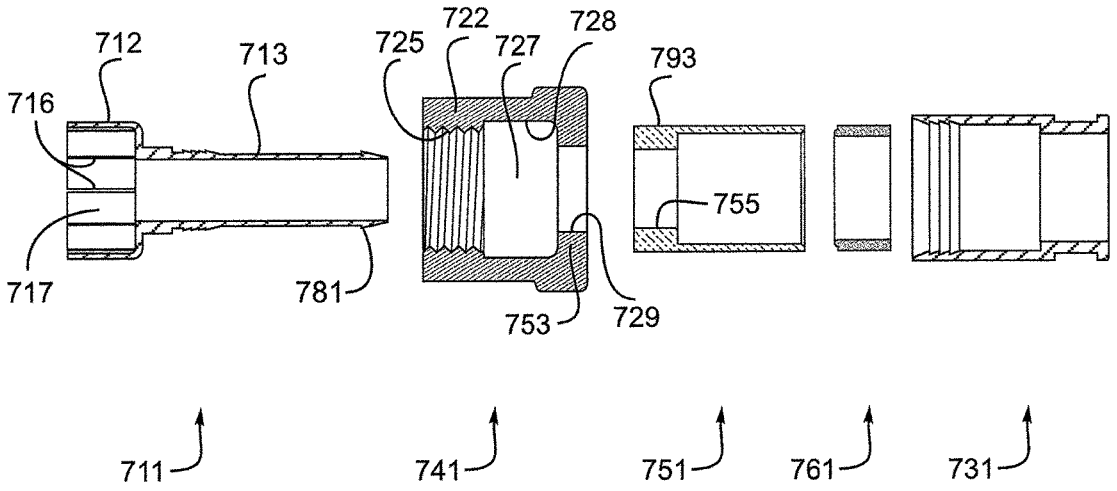
Figure 7C:
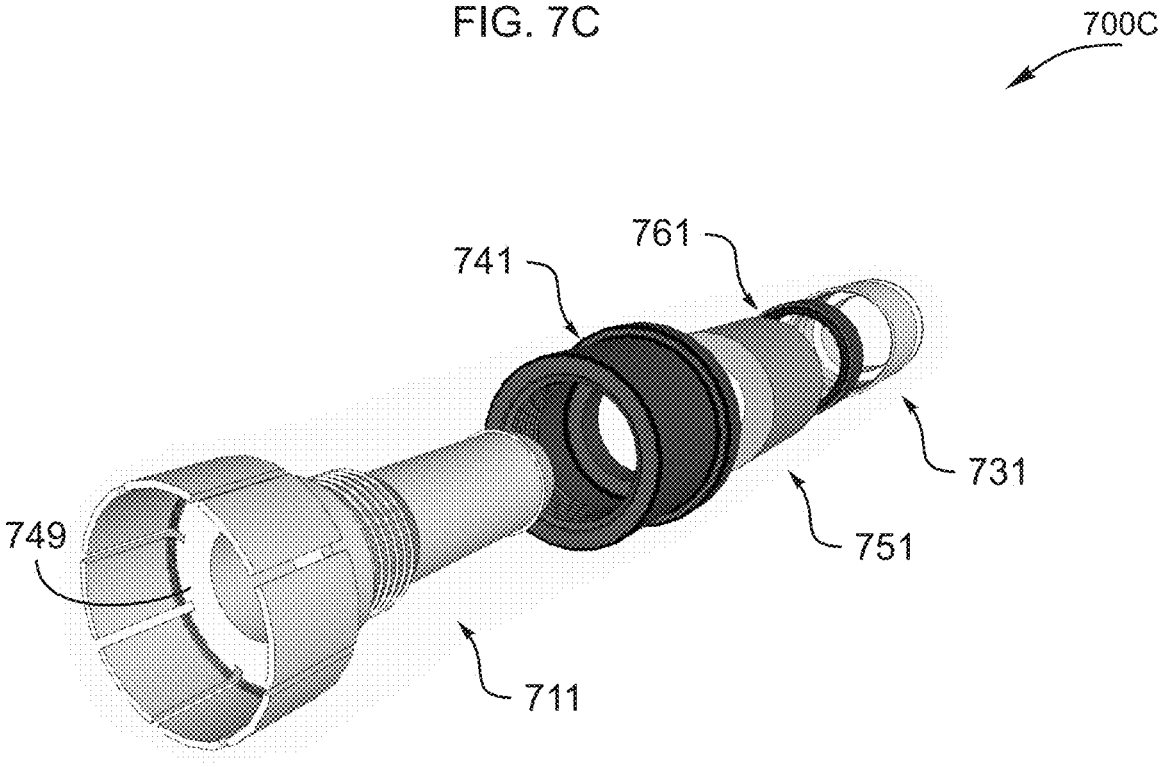

FIGS. 7A-C show cross-sectional, exploded, and perspective views of another embodiment of the push-on coaxial connector of the present invention 700A-C. The connector includes a hollow housing 721, a post 711 inserted in the housing, and an end cap 731 slidably engaging the housing. These parts are arranged to form a port grip 702, a joint 704, and a cable clamp 706.

Notably, the housing 721 may be made from multiple parts or made as a single integral part as in a continuously molded or extruded part or a part machined from a piece of stock. In the embodiment shown, a multipart housing includes a fastener 741 and a body 751.

The post 711 includes an end bell 712, a stem 713, and a stem neck 719 adjoining the end bell. In various embodiments, an annular disc 749 joins the end bell and the stem neck. And, in some embodiments, the post stem includes an external barb(s) such as a distal end barb 781. In various embodiments, the barbs stand proud of the stem external surface. One or multiple rows of barbs may be used.

The port grip 702 includes a housing bonnet 722 enveloping the end bell 712 of the post 711. The bonnet 722 includes a threaded mouth 725 and an adjacent bonnet throat 727 for holding the post end bell. A mating connector such as a port (see e.g. FIG. 3C, 340) is engaged via insertion through the threaded mouth and into the end bell.

Mechanical engagement of the connector 700A with a mated port includes, for example, bonnet 722 to port engagement and end bell 712 to port engagement. Electrical contact of the connector with a mated port includes, for example, end bell to port engagement. And, in some embodiments, sealing contact of the connector with a mated port includes bonnet to port engagement as between the bonnet threads 725 and the port or external threads of the port. Notably, use of the term "bonnet threads" refers to an irregular surface within the bonnet suitable for engaging and/or sealing the bonnet with a mating connector such as a port. In some embodiments, the bonnet threads are ⅜-32 UNEF type threads that are molded into the bonnet.

In various embodiments, a radial interference fit 752 between a throat 727 inner surface 728 and the end bell 712 resists rotation of the bonnet 722 and/or the housing 721 about the post 711. The end bell may be slotted 716 to form end bell fingers 717 that more readily and resiliently grasp an inserted port.

The joint 704 includes a housing leading collar 753 and a housing trailing collar 793 through which the post 711 is inserted. In particular, the post stem neck 719 is positioned in the leading and trailing housing collars.

A second interference fit 754 may be used between a leading collar 753 inner surface 729 and the post neck 719 to resist rotation of the fastener 741 and the post 711. A third interference fit may be used between a trailing collar 793 inner surface 755 and the post neck 719 to resist rotation of the body 751 and the post 711. Various embodiments include a body entry 7551.

In various embodiments, a radial interference fits 754, 794 between the collars 753, 793 and the stem neck 719 resist rotation of the collars and/or the housing 721 about the post 711. And, in combination, the collars and the stem neck provide a passageway 785 for a coaxial cable 308 center conductor 302, the passageway lying between the port grip 702 and the cable clamp 706 (See e.g., FIG. 7A). Embodiments may provide feature(s) at a joint periphery such as at a leading collar periphery 726 useful for gripping and pushing the connector onto a mating part. Such features may include one or more of suitable raised surfaces, depressions, knurls, or similar geometries(s).

The cable clamp 706 includes a housing can 724, a trailing portion of the post stem 713, and an end cap 731. The can encircles the post stem 713 and/or the post distal stem barb(s) 781. Slidably engaging the can, the end cap may encircle or be encircled by the can.

In the embodiment shown, the end cap 731 encircles the can 724 and carries an internal wedge 761 such as a metallic, polymeric, or resilient wedge. Here, sliding the end cap toward the leading collar 753 forces the wedge into an annular space 740 between the post 711 and the can 724. When a coaxial cable 308 is inserted in the connector, movement of the wedge into the annular space fixes the cable within the connector by pressing the cable braid and/or ground conductor 306 against the post and/or onto the barb 781. In various embodiments, the post external surface or a portion thereof may be knurled or otherwise deformed to enhance friction between the post and the coaxial cable.

In various embodiments, the post 711 and/or end cap 731 may be made from conductor(s) such as metal(s), for example, brass alloy(s). In various embodiments, the housing bonnet 722 and/or leading end 701 may be made from polymer(s) such as EDPM. In various embodiments, the housing can 724 and/or trailing end 703 may be made from polymers such as plastic(s) or from metals such as brass or brass alloy(s). In an embodiment, the housing leading end 701 is made from EDPM, the housing trailing end 703 is made from plastic(s), the post 711 is made from a nickel plated brass alloy, the end cap 731 is made from a nickel plated brass alloy, and the wedge is made from materials including one or more of rubber, silicon rubber, and POM (polyoxymethylene).

Figure 8A:
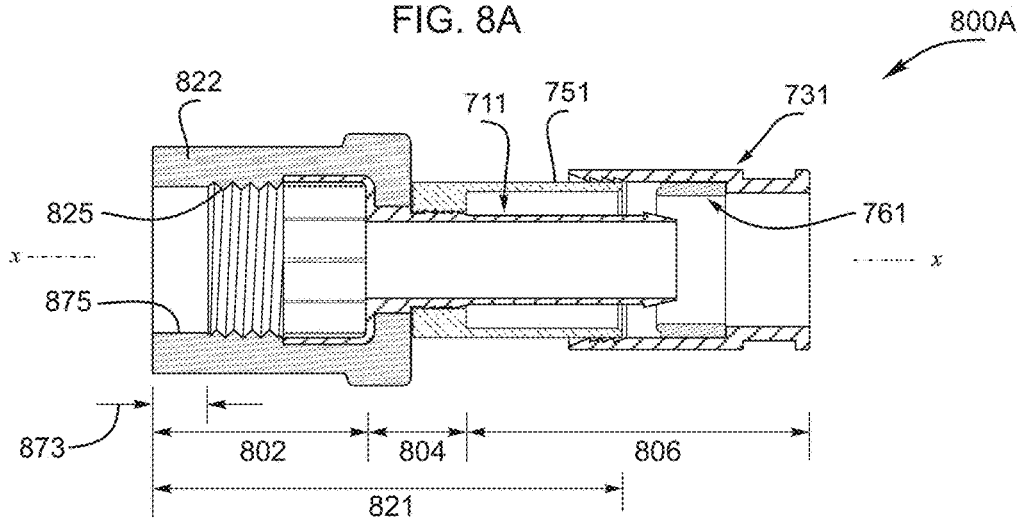
FIGS. 8A-C show cross-sectional, exploded, and perspective views of a sixth embodiment of the connector of FIG. 1.
Figure 8B:
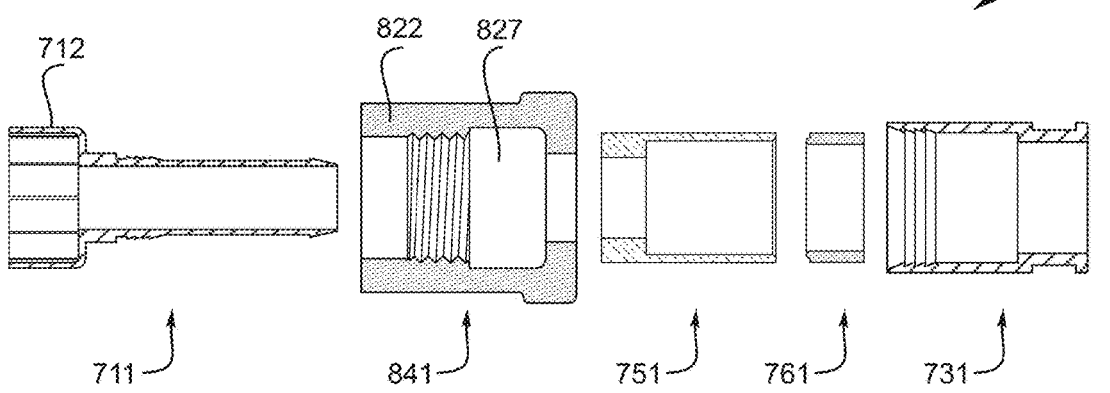
Figure 8C:
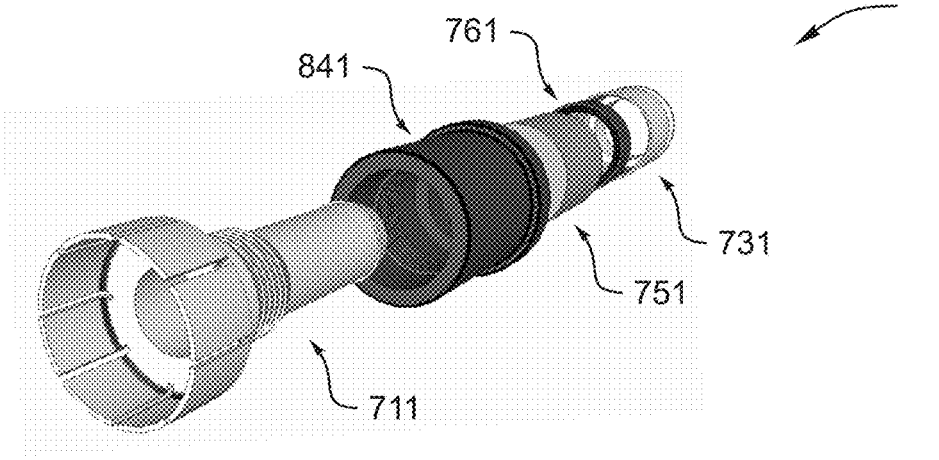

FIGS. 8A-C show cross-sectional, exploded, and perspective views of another embodiment of the push-on coaxial connector of the present invention 800A-C. The connector includes a hollow housing 821, a post 711 inserted in the housing, and an end cap 731 slidably engaging the housing and carrying an internal wedge 761. Notably, the housing 821 may be made from multiple parts or made as a single integral part as in a continuously molded or extruded part or a part machined from a piece of stock. In the embodiment shown, a multipart housing includes a fastener 841, and a body 751.

These parts are arranged to form a port grip 802, a joint 804, and a cable clamp 806. The joint 804 and cable clamp 806 are similar to those of FIG. 7A.

The port grip 802 includes a housing bonnet 822 enveloping an end bell 712 of the post 711. The bonnet includes a threaded zone 825 between a bonnet mouth 873 and a bonnet throat 827. A mating connector such as a port (see e.g. FIG. 3C, 340) is engaged via insertion through the bonnet mouth and bonnet throat into the post end bell. In various embodiments, the threaded zone and bonnet throat are similar to those mentioned above.

Among other things, the bonnet mouth may provide improved mechanical coupling between the connector 800A and a mating part such as a port and improved resistance to ingress of moisture between the bonnet 822 and a mating part. In some embodiments, the bonnet mouth has a smooth inner wall 875 for sealing against a mated port.

FIGS. 9A-E show applications of push-on connectors including use of ganged push-on connectors as with plugable blocks of connectors 900A-E.

Figure 9A:
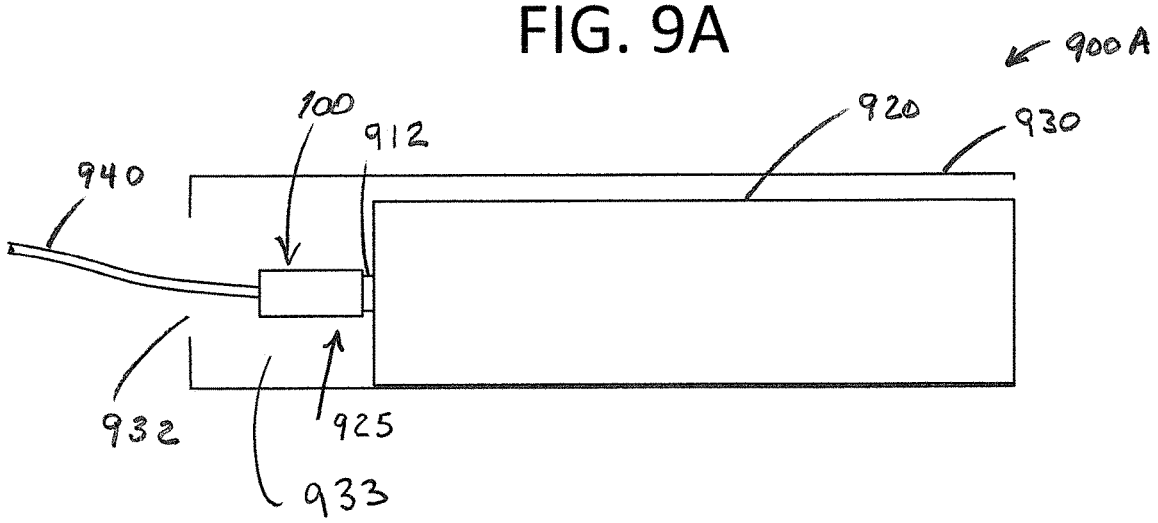
FIGS. 9A-E show applications for the connector of FIG. 1.
Figure 9B:
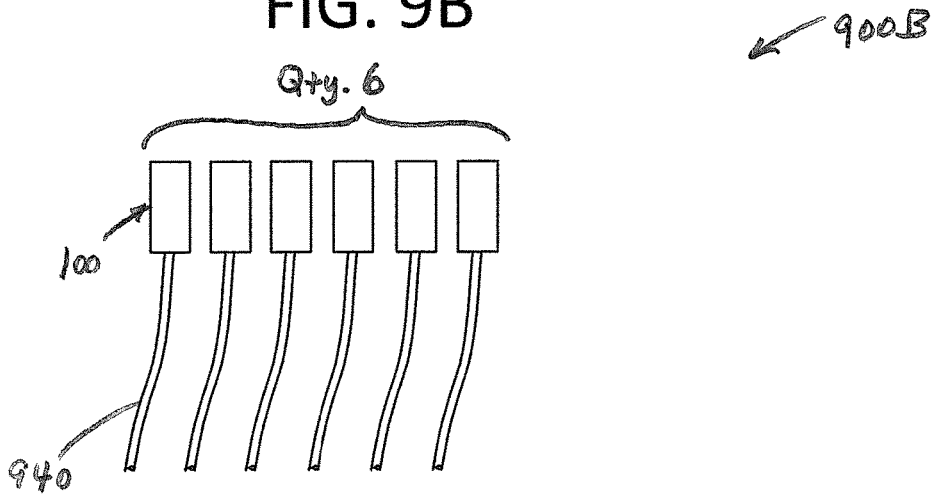

FIGS. 9A-B show push-on connectors in an application with a rear entry housing 900A-B. In FIG. 9A, a containment or housing 930 such as a rack or portion thereof ("housing") encloses an RF (Radio Frequency) device 920. See for example the RF device (multi-port switch) of US20100071009 A1 filed Mar. 26, 2008 and included by reference herein in its entirety and for all purposes.

In various embodiments, RF connections 925 made with the RF device are located in a confined space. Examples include confined spaces between the housing and the device such as the confined space 933 shown in FIG. 9A.

An RF connection may include male and female coaxial connectors. Female connectors are frequently termed "ports." These ports are for interconnection with a mating male connector which typically includes a fastener such as a rotatable nut for encircling and engaging a port as by a threaded engagement. In various embodiments, the RF connections are made with F-Type connectors. For an illustrative rotatable fastener, see U.S. Pat. No. 8,636,541 filed Dec. 27, 2011 which is included herein by reference in its entirety and for all purposes.

As seen, the confined space 933 where the RF connection 925 is made and a confined space access such as a rear access 932 may be small compared to a human hand or to a tool used to make the connection. Further, the size of the confined space 933 may preclude proper grasping and/or turning of male connector fasteners.

For example, a housing 130 with a rear access 932 may provide adequate hand access space for pushing a push-on connector 100 onto an RF device port 112 but inadequate space for rotating a male connector fastener.

FIG. 9B shows a group of 6 connectors 100 with 6 trailing coaxial cables 940 for mating with 6 ports on an RF device such as the illustrated RF device 920. Notably, the confined space problem may be exacerbated when a plurality of ports 912 (one visible) is located in the confined space 933.

For example, closely spaced ports may, irrespective of the confined space limitations, preclude proper tightening of male connector fasteners whether by hand or by tool (e.g., port spacing designed to avoid contact of adjacent fasteners such as spaces about equal to port diameter). Further, non-linear connector arrangements (not shown) present additional access issues where, for example, a connector is surrounded by other connectors.

Solutions for these problems may be provided by embodiments of the push-on connectors described herein, e.g. the connector 100 of FIG. 1. Because the push-on connector may be pushed onto (engaged with) a port or pulled from (disengaged from) a port without rotation of a fastener, confined spaces and port spacing need not provide for space required to rotate a male connector fastener.

Figure 9C:
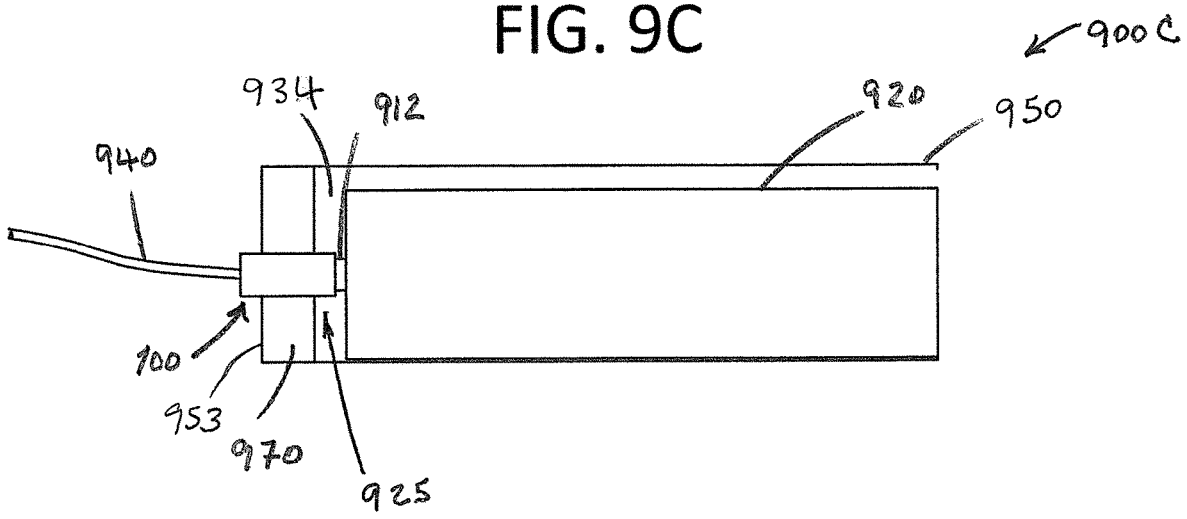
Figure 9D:
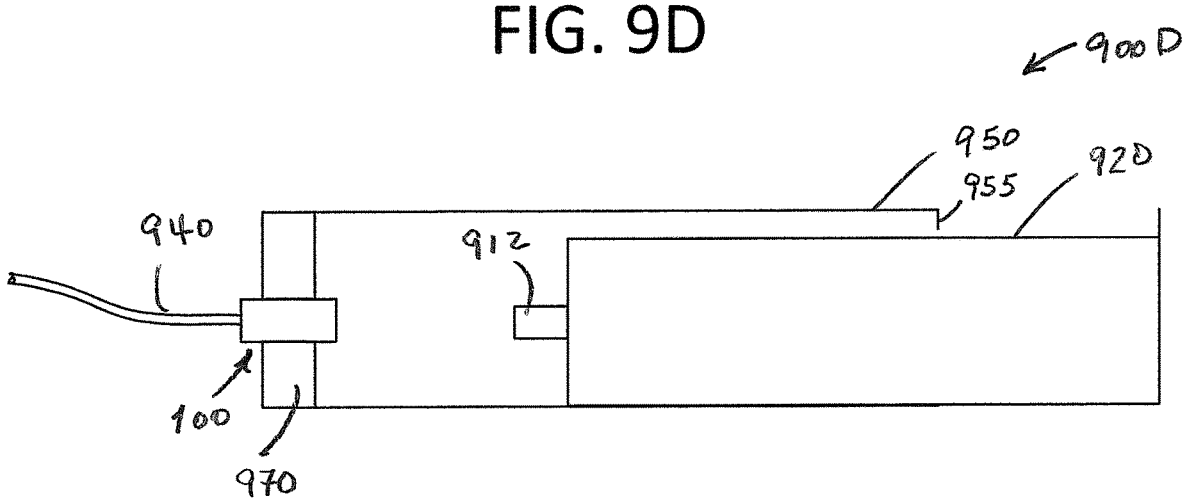
Figure 9E:
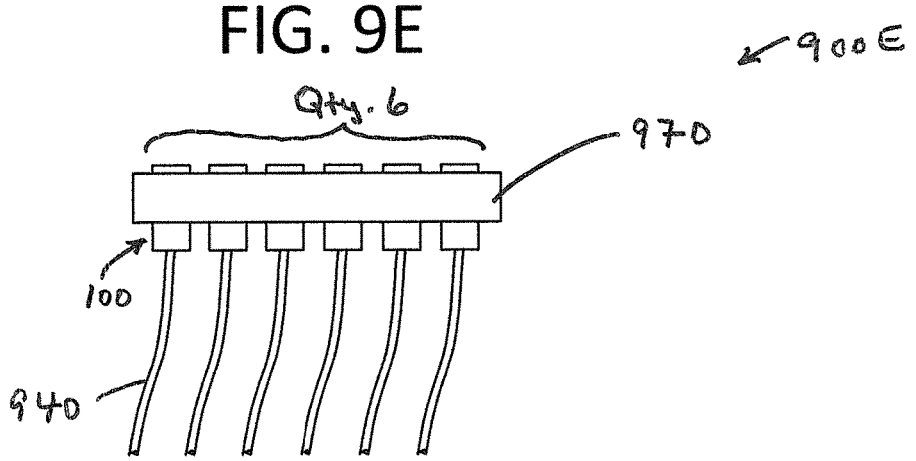

FIGS. 9C-E show push-on connectors used in housing with a backplane 900C-E. In FIG. 9C, a containment or housing 950 such as a rack or portion thereof ("housing") encloses an RF device 920. Between the housing and the RF device is a space 934 where an RF connection 925 is made with the device. In some embodiments the space 934 is a closed or normally closed space. And, in some embodiments the space 934 is not intended for and/or inaccessible to human hands.

As shown, the RF connection 925 in the substantially closed space 934 is not accessible from the rear 953. Where connections 925 are not intended for access by hand, embodiments of the push-on connectors described above and below may solve the problem of hands-free mating and de-mating connectors.

FIG. 9E shows a group of 6 male connectors 100 with 6 trailing coaxial cables 940 for mating with 6 ports on the RF equipment 920. Notably, the connectors are ganged together via a ganging structure 970 which holds the connectors in fixed positions relative to each other.

Where the ganged connectors 900E are included in or form a backplane such as a housing backplane, insertion of the RF device 920 into the housing 950 results in simultaneous mating of the RF device ports 912 with respective male connectors 100 held by the ganging structure 970. This operation may be termed "plugging" the RF device into the housing. See e.g., FIG. 9C.

In similar fashion, withdrawal of the RF device from the housing results in simultaneous de-mating of the RF device ports from respective male connectors. This operation may be termed "unplugging" the RF device from the housing. See e.g., FIG. 9D.

It should be noted that embodiments of the ganged connectors 900E may be used in a confined space or not. Where the ganged connectors are used in a confined space, they may be used in a confined space intended for hand access or in a confined space that is not intended for hand access.

As skilled artisans will appreciate, one or more embodiments of push-on connectors and/or ganged push-on connectors disclosed herein provide benefits including one or more of ease of connector mating and de-mating, simultaneous connector mating and de-mating, improved connector alignment, back to back housing arrangements, reduced housing sizes, and assurance of correct connector order.

While various embodiments of the present invention have been described above, it should be understood that they have been presented by way of example only, and not limitation. It will be apparent to skilled artisans that various changes in the form and details can be made without departing from the spirit and scope of the invention. As such, the breadth and scope of the present invention should not be limited by the above-described examples, but should be defined only in accordance with the following claims and equivalents thereof.

What is claimed is:

1. A connector is a push-on male F-type coaxial connector comprising:
an elastomeric bonnet and a body;
a leading collar adjacent to a trailing collar;
the leading collar opposite a bonnet mouth;
the trailing collar opposite a body entry;
an end bell opposite a stem with a neck therebetween;
end bell crenelations for grasping a port;
the elastomeric bonnet for pressing the crenelated end bell for enhancing a grip; and,
the leading and trailing collars pressing the neck.

2. The connector of claim 1 further comprising:
an end cap for engaging the body; and,
the end cap movable toward the elastomeric bonnet for fixing a coaxial cable against a stem.

3. The connector of claim 2 further comprising:
a wedge movable with the end cap for fixing a coaxial cable against the stem.

4. The connector of claim 3 further comprising:
an end cap internal shoulder for abutting the wedge.

5. The connector of claim 3 wherein:
the body inserted in the end cap when the end cap fixes a coaxial cable against the stem.

6. The connector of claim 3 wherein:
the wedge inserted in the body when the wedge fixes a coaxial cable against the stem.

7. A ganged connector assembly comprising:
a block holding adjacent male F-type connectors;
the connectors irrotatable with respect to the block;
each connector having an elastomeric bonnet encircling a crenelated end of a post; and,
the elastomeric bonnet pressing the crenelations toward a post centerline;
wherein the block of connectors engages plural mating connectors when the the block meets and is pushed onto the mating connectors.

8. The ganged connector assembly of claim 7 further comprising:
a collar interconnecting the elastomeric bonnet and a cable clamp can.

9. The ganged connector assembly of claim 8 further comprising:
an end cap for engaging the end clamp can and fixing a coaxial cable therein.

10. The ganged connector assembly of claim 9 wherein:
the end cap is for engaging the cable clamp when the cable clamp is inserted in the end cap.

* * * * *